US006036524A

United States Patent [19]

Suzuki et al.

[11] Patent Number: 6,036,524

[45] Date of Patent: Mar. 14, 2000

[54] CONNECTOR DEVICE HAVING SPRING MECHANISM

[75] Inventors: Masaji Suzuki; Nori Inoue, both of Yokkaichi; Kensaku Takada, Nagoya, all of Japan

[73] Assignees: Sumitomo Wiring Systems, Ltd., Yokkaichi; Harness System Technologies Research, Ltd., Nagoya; Sumitomo Electric Industries, Ltd., Osaka, all of Japan

[21] Appl. No.: 09/229,601

[22] Filed: Jan. 13, 1999

Related U.S. Application Data

[62] Division of application No. 08/691,032, Aug. 7, 1996.

[30] Foreign Application Priority Data

| | | | |
|---|---|---|---|
| Aug. 9, 1995 | [JP] | Japan | 7-225773 |
| Aug. 9, 1995 | [JP] | Japan | 7-225774 |
| Aug. 9, 1995 | [JP] | Japan | 7-225775 |

[51] Int. Cl.[7] ..... H01R 3/00

[52] U.S. Cl. ..... 439/354; 439/923; 439/155

[58] Field of Search ..... 439/354, 923, 439/155, 489, 152

[56] References Cited

U.S. PATENT DOCUMENTS

| | | | |
|---|---|---|---|
| 4,526,431 | 7/1985 | Kasukawa | 439/923 |
| 5,171,291 | 12/1992 | D'Alayer De Costemore D'Arc et al. | 439/152 |
| 5,178,552 | 1/1993 | Jinno et al. | 439/152 |
| 5,183,410 | 2/1993 | Inaba et al. | 439/354 |
| 5,376,014 | 12/1994 | Sumida | 439/352 |
| 5,746,619 | 5/1998 | Harting et al. | 439/352 |
| 5,848,912 | 12/1998 | Okabe | 439/489 |

FOREIGN PATENT DOCUMENTS

| | | |
|---|---|---|
| 41 05 985 C1 | 1/1992 | Germany . |
| 64-51276 | 3/1989 | Japan . |
| 5-121121 | 5/1993 | Japan . |
| 5-43484 U | 6/1993 | Japan . |
| 5-53157 U | 7/1993 | Japan . |
| 2 219 446 | 12/1989 | United Kingdom . |

*Primary Examiner*—Paula Bradley
*Assistant Examiner*—Katrina Davis
*Attorney, Agent, or Firm*—Oliff & Berridge, PLC

[57] ABSTRACT

The connector is structured such that a spring piece member 30 supported by a male side connector housing 10 can be compressed in the two directions of the sliding motion of the connector when the connector is mounted and removed, a seesaw type lever piece member 40 disposed so as to be seesawable in the sliding direction of a female connector housing 20 can be inclined forwardly and backwardly into engagement with the two end portions of the spring piece member 30, and the seesaw type lever piece member 40 can be inclined according to the fitted state of the connector by a waiting side guide projection piece 17 and a movable side guide 45 respectively provided in the male side and female side connector housings 10 and 20. Thanks to this structure, resilient forces respectively to pull back and push out the two connector housings in a half fitted state can be obtained from the same elastic member, that is, the spring piece member 30, and engagement and disengagement between the seesaw type lever piece member 40 and the spring piece member 30 can be achieved within a small operation range, which makes it possible to realize a compact and half fitted connector.

3 Claims, 14 Drawing Sheets

CONNECTOR DEVICE HAVING SPRING MECHANISM

This is a Division of application Ser. No. 08/691,032 filed Aug. 7, 1996. The entire disclosure of the prior application is hereby incorporated by reference herein in its entirety.

BACKGROUND OF THE INVENTION

The present invention relates to a connector for use in a wire harness for a vehicle. Particularly, the present invention relates to a connector which includes a push-back or a pull-back mechanism to prevent a half fitted state.

Conventionally, as a connector of this type, there is known a connector which is disclosed in Japanese Utility Model Publication 64-51276 and is shown in FIGS. 1 to 3.

In FIGS. 1 to 3, a connector 1 comprises a connector housing 2, which includes a hood portion 2*a* in the front portion thereof and is capable of holding within the hood portion 2*a* a male terminal metal member 4*a* in an erect manner, and a connector housing 3 which is formed so as to be insertable into the hood portion 2*a* and is also capable of holding a female terminal metal member 4*b* connectable with the male terminal metal member 4*a*, while there is provided between the two connector housings 2 and 3 a spring mechanism 5 which can generate such a force which causes the two connector housings 2 and 3 to push them out from each other or pull them back toward each other according to their mutual insertion positions.

The spring mechanism 5 includes two conical slopes 6*a* and 3*a* which are formed so as to face each other in the insertion surfaces of the connector housings 2 and 3. In particular, one conical slope 3*a* is provided on the outer peripheral surface of the connector housing 3, while the other conical slope 6*a* is provided in a drive piece member 6 which is supported in such a manner that it can be rotated with respect to the connector housing 2 and also which is energized toward the connector housing 3.

In connecting the connector housings 2 and 3 with each other or disconnecting them from each other, when the terminal metal members 4*a* and 4*b* are in half engagement with each other, the slanting surfaces of the conical slopes 6*a* and 3*a* are engaged with each other due to the resilient force of the coil spring 7, which applies such a force to the connector housings 2 and 3 that moves them in the inserting or removing direction of the connector 1. That is, when the mutually facing slanting surfaces of the conical slopes 6*a* and 3*a* are in mutual contact with each other, the two connector housings 2 and 3 are respectively given a force which pushes them out from each other in the removing or separating direction. On the other hand, when the oppositely disposed slanting surfaces thereof are in mutual contact with each other, the connector housings 2 and 3 are respectively given a force which pulls them back toward each other in the fitting or engaging direction.

However, in the above-mentioned conventional connector, there are left the following problems to be solved.

That is, at a position where the push-out and pull-back states are switched over to each other, there exists the above-mentioned force no longer in the inserting or removing direction, which raises a possibility that the connector can be engaged in a half fitted state.

Also, in the neighborhood of the above-mentioned state switch-over position, the force in the inserting or removing direction is reduced in magnitude and, in order to make up for the reduced force, if there is employed a spring having a greater force, then a greater inserting or removing force is required of an operator, which results in a lowered operationability of the connector.

Further, due to the fact that the direction of the resilient force of the coil spring is switched over by means of the engagement between the slanting surfaces of the conical slopes, there can be obtained only a poor efficiency and, therefore, the size of the connector must be large in order to obtain a desired inserting or removing force.

Conventionally, as connectors including a push-back mechanism to prevent a half fitted state, there are known connectors which are disclosed in Japanese Utility Model Publications 5-43484, 5-53157, and Japanese Patent Publications 5-121121 respectively.

Each of them includes a pair of connector housings and a spring to generate a reaction force, in which a push-out force is generated by means of the reaction of the spring during a connector fitting operation to thereby prevent the connector housings from being left half fitted with each other. When compared with the connectors that have been used before, the above-mentioned conventional connectors respectively include a movable member which can be used to remove the reaction of the spring when the connector fitting operation is completed.

In the above-mentioned conventional connectors, it is necessary to separately provide a movable member to remove the reaction of the spring on completion of the connector fitting operation, which increases the number of parts as well as takes time and labor for assembling it to the connector.

As a spring storage mechanism of the conventional connector, there is known a mechanism which comprises a box-shaped storage case having an opening for insertion of a spring and a cover member capable of covering this opening, wherein the opening of the storage case is closed after the spring is stored through the opening into the storage case; and, there is also known another mechanism which comprises a box-shaped storage case having one end left opened and including a lance on the inner peripheral surface thereof, wherein a spring is pushed into the storage case and secured to the lance.

However, in the former mechanism, the spring can be stored into the spring storage case without using any special jig, but the spring storage case is composed of two parts. In the latter, although the spring storage case has an integral structure, the spring must be pushed in more deeply than the opening of the storage case in order to be able to secure the spring to the lance provided on the inner peripheral wall of the storage case, which requires a jig.

SUMMARY OF THE INVENTION

The present invention aims at eliminating the drawbacks found in the above-mentioned connector. Accordingly, it is an object of the invention to provide a connector which not only can surely avoid a half fitted state but also can be made compact and simple in structure.

To attain the above object, according to the first aspect of the invention, there is provided a connector which comprises a pair of connector housings respectively holding a pair of mutually fittable and connectable terminal metal members and slidable between a locked state and a separated state, and a pull-back mechanism mounted between the pair of connector housings for acting on the connector housings to pull them back toward each other in the sliding motion from the locked position to the separated position and, when the two connector housings are completely switched over to the separated state, for releasing the pull-back action.

Also, according to the invention, the pull-back mechanism includes an elastic member provided in one of the pair of connector housings so as to extend in the sliding direction thereof, and a contact mechanism which is supported in the other connector housing and also which is engageable with the elastic member in the sliding motion of the connector housings from the locked state to the separated state and, when the two connector housings are completely switched over to the separated state, releases the engagement thereof with the elastic member.

Further, according to the invention, the contact mechanism includes a lever piece member supported in an inclinable manner and engageable with or disengageable from the elastic member according to the inclined states thereof, and an inclining guide which, during the sliding motion of the connector housings, inclines the lever piece member into a given inclined state to bring it into engagement with the elastic member in the sliding motion of the connector housings from the locked state to the separated state and, when the two connector housings are completely switched over to the separated state, releases such engagement between the lever piece member and the elastic member.

In the invention as structured in the above-mentioned manner, if the pair of connector housings are slid by an operator in such a manner that they are switched from the locked state over to the separated state, then the pull-back mechanism continues to pull back the two connector housings toward each other against the sliding force of the connector just before they are completely switched over to the separated state. For this reason, if the operator takes off his or her hands from the two connector housings during the connector sliding motion, then the two connector housings are pulled back toward each other to thereby return back to the locked state, so that the terminal metal members respectively stored in the connector housings are also fitted and connected with each other. However, if the two connector housings are slid on and are completely turned into the separated state by the operator, then the pull-back mechanism removes its pull-back operation at the completely switched time, so that the two connector housings are both free from the pull-back operation of the pull-back mechanism and thus the terminal metal members are also completely removed from their fitted connection.

Also, in the invention as structured in the above-mentioned manner, when the two connector housings are slid from the locked state to the separated state, the contact mechanism provided in the other connector housing is engaged with the elastic member while the two connector housings are being switched from the locked state over to the separated state. Due to the fact that, in a process in which the connector housings are pulled out, the contact mechanism is engaged with the elastic member disposed in such pull-out direction, the elastic member is compressed or extended to generate a resilient force which acts on the two connector housings in such a manner that the two connector housings are caused to pull back toward each other. On the other hand, if the two connector housings are completely switched over to the separated state, then the contact mechanism is removed from its engagement with the elastic member, so that the elastic member returns back to its original state due to its own elasticity and the two connector housings are also set free from the force causing them to pull back toward each other.

Further, in the invention as structured in the above-mentioned manner, when the two connector housings are slid from the locked state to the separated state, the inclining guide inclines the lever piece member to a given angle, so that the lever piece member is engaged with the elastic member. Therefore, during the sliding motion of the two connector housings, the elastic member is flexed to thereby exert a pull-back force on the two connector housings. However, when the two connector housings are completely switched over to the separated state, then the inclining guide changes the inclined state of the lever piece member to thereby remove the engagement of the lever piece member with the elastic member, so that the elastic member is allowed to return back to its original state.

Still further, according to the invention, there is provided a connector which includes: a pair of connector housings holding a pair of mutually fittable terminal metal members and slidable with respect to each other between a locked state and a separated state; an elastic member supported in such a manner that it can exert its resilient force to one of the pair of connector housings in both directions along the sliding direction thereof; a lever piece member supported so as to be inclinable with respect to the other of the pair of connector housings, and, according to the inclined states thereof, engageable with the elastic member to thereby allow the elastic member to exert its resilient force in a given direction or disengageable from the resilient member; and, an inclining guide, for inclining the lever piece member during the sliding motion of the pair of connector housings such that, in the separating operation, the lever piece member is engaged with the elastic member to exert its pull-back resilient force in the sliding motion of the connector housings from the locked state and the separated state and is disengaged from the elastic member when the connector housings are completely switched over to the separated state, and also such that, in the fitting operation, the lever piece member is engaged with the elastic member to exert its push-out resilient force in the sliding motion of the connector housings from the separated state to the locked state and is disengaged from the elastic member when the pair of connector housings are completely switched over to the locked state.

Moreover, according to the invention, the elastic member is supported in such a manner that it can be compressed from both directions; the lever piece member is supported in a seesaw manner such that it extends in parallel to the sliding direction of said connector housings and faces said elastic member, and the lever piece member includes in the two end portions thereof two contact pieces which are respectively projected out toward the elastic member; and, the inclining guide, in the fitting operation, inclines the seesaw type lever piece member forwardly in connection with the sliding motion of the connector housings from the separated state to the locked state to push out one of the contact pieces disposed in the rear end portion thereof to thereby bring it into engagement with the front end side of the elastic member, and, in the separating operation, inclines the seesaw type lever piece member backwardly in connection with the sliding motion of the connector housings from the locked state to the separated state to push out the other contact piece in the front end portion thereof to thereby bring it into engagement with the rear end side of the elastic member.

In addition, the elastic member includes an engaging piece engageable with a given end portion, and the lever piece member, when it is inclined, is engageable with the engaging piece so that it can be engaged with the elastic member indirectly.

In the invention as structured in the above-mentioned manner, if the two connector housings are moved or slid so that they can be fitted with each other, then the inclining guide inclines the lever piece member to thereby bring the lever piece member into engagement with the elastic member. For this reason, during the sliding motion of the two connector housings, the elastic member is flexed to thereby exert a repelling or resilient force on the two connector housings, that is, the elastic member exerts such a force as causes the two connector housings to push out from each other. Therefore, if the operator takes off his or her hands from the two connector housings during the connector sliding motion, then the two connector housings are returned back to the separated state which is the state thereof before they are operated or slid by the operator, and thus the terminal metal members, which have started to be fitted and connected with each other halfway, are also pulled apart from each other. However, if the two connector housings are completely switched over to the locked state, then the inclining guide changes the inclined state of the lever piece member to thereby remove the engagement of the lever piece member with the elastic member, with the result that the two connector housings are set free from the mutually pushing-out force and the elastic member is also allowed to return back to its original state.

On the other hand, if the two connector housings held in the locked state are slid in such a manner that they can be separated from each other, then the inclining guide inclines the lever piece member to thereby bring it into engagement with the elastic member. Due to this, during the sliding motion of the two connector housings, the elastic member is flexed to thereby exert a repelling or resilient force against the sliding motion of the two connector housings, so that the two connector housings are caused to pull back toward each other. Therefore, if the operator takes off his or her hands from the two connector housings, then the two connector housings are returned back to the locked state which is the state thereof before they are operated or slid by the operator, and thus the terminal metal members, which have been halfway removed from the mutually fitted and connected state, are pulled back again to the fitted and connected state. However, if the two connector housings are completely switched over to the separated state, then the inclining guide changes the inclined state of the lever piece member to thereby remove the engagement of the lever piece member with the elastic member, with the result that the two connector housings are now free from the mutually pulling-back force caused by the elastic member and the elastic member is also allowed to return back to its original state.

Moreover, in some embodiments, the seesaw type lever piece member and the elastic member are basically disposed in parallel to each other so that they are prevented from being engaged with each other. However, when the two connector housings are operated so that they can be separated from each other, the inclining guide inclines the lever piece member backwardly to thereby move upward the contact piece in the front end thereof into engagement with the elastic member. Due to this, during the sliding operation of the two connector housings, the front end side of the elastic member is pulled backwardly to thereby generate a resilient or repelling force against the sliding motion of the two connector housings and, if the two connector housings are perfectly switched over to the separated state, then the lever piece member is returned back to its horizontal state to thereby move down the front end thereof, which removes the engagement of the lever piece member with the elastic member. On the other hand, when the two connector housings are operated so that they can be fitted with each other, the lever piece member is inclined forwardly to thereby move the contact piece in the rear end portion thereof upward into engagement with the elastic member. Therefore, during the sliding operation of the connector housings, the rear end side of the elastic member is pulled forwardly to thereby generate a repelling force against the sliding motion of the two connector housings and, if the two connector housings are switched over to the locked state perfectly, then the lever piece member is returned back to its horizontal state to thereby move down the rear end thereof, so that the engagement of the lever piece member with the elastic member can be removed.

In addition, in the invention as structured in the above-mentioned manner, when the lever piece member is inclined, it is engaged with the engaging piece which is provided in the elastic member and is engageable with a given end portion, so that the lever piece member can be engaged with the elastic member indirectly.

To attain the above object, according to the second aspect of the invention, there is provided a connector composed of a pair of connector housings and including a push-back mechanism which, while the two connector housings are half fitted with each other, pushes back the connector housings apart from each other by the elastic force of a push-back spring, in which the push-back mechanism includes: a push-back spring supported in one connector housing in such a manner that it is positioned along the insertion direction of the other connector; a flexible arm formed integral with the other connector housing so as to face the push-back spring and having such flexibility as allows itself to advance to or retreat from the push-back spring, the flexible arm including a securing projection securable to the push-back spring; and, an engaging mechanism composed of guide inclined surfaces and guide projections respectively provided in the flexible arm and in one connector housing. According to the engaging mechanism, depending on whether the pair of connector housings are to be fitted with each other or pulled out from each other, the guide inclined surface and guide projection can be engaged with each other to thereby be able to incline the flexible arm. In particular, in the connector fitting operation, the guide projections are respectively allowed to go up onto the guide inclined surfaces to thereby incline the flexible arm toward one connector housing so that the securing projection of the flexible arm can be secured to the push-back spring and, on completion of the connector fitting operations the guide projections are respectively allowed to go beyond the guide inclined surfaces to thereby withdraw the flexible arm away from one connector housing so that the securing projection can be removed from the push-back spring. On the other hand, in the connector pull-out operation, the guide projections are allowed to pass under the guide inclined surfaces respectively and, in the initial stage of the connector fitting operation, regardless of the inclined state of the flexible arm, the guide projections are respectively forced to go up onto the guide inclined surfaces.

Here, referring to a front and back relationship between the guide projections and guide inclined surfaces, the relationship varies relatively depending on the engagement relationship between the securing projection and push-back spring, that is, it is not always necessary that the front surface must be an upper surface while the back surface must be a lower surface.

Also, in the above-mentioned connector, the guide inclined surfaces are formed in the above-mentioned one connector housing, while the guide projections are provided in the flexible arm.

Further, in the above-mentioned connector, one of the above-mentioned connector housings includes a hood portion into which the other connector housing can be inserted and also supports the push-back spring in the peripheral wall of the hood portion, whereas the other connector housing not only can be inserted into the hood portion of the one connector housing but also, while forming a space in the portion thereof facing the push-back spring, supports the flexible arm in this space.

Still further, in the connector pull-out operation, when the guide projections pass under the guide inclined surfaces respectively, the flexible arm can be flexed more greatly than it can be flexed in the initial stage of the connector fitting operation.

In the invention as structured in the above-mentioned manner, in one connector housing, there is supported the push-back spring in such a manner that it is disposed along the insertion direction of the other connector housing, while in the other connector housing there is integrally provided the flexible arm in such a manner that it faces the push-back spring. The flexible arm has such flexibility as allows itself to advance to and retreat from the push-back spring and also includes the securing projection securable to the push-back spring, while the guide inclined surfaces and guide projections cooperate together in forming an engaging mechanism. Depending on whether the pair of connector housings are to be fitted with each other or pulled out from each other, the engaging mechanism inclines the flexible arm to thereby bring the securing projection of the flexible arm into engagement with the push-back spring, causing the push-back spring to generate a reaction. That is, during the connector fitting operation, the flexible arm is inclined toward one connector housing in such a manner that the guide projections are respectively allowed to go up onto the guide inclined surfaces to thereby secure the securing projection of the flexible arm to the push-back spring, on completion of the connector fitting operation. The guide projections are then allowed to go beyond the guide inclined surfaces respectively to thereby withdraw the securing projection so that the securing projection can be removed from the engagement with the push-back spring. During the connector pull-out operation, the guide projections are respectively allowed to pass under the guide inclined surfaces, and, in the initial stage of the connector fitting operation, the guide projections are respectively forced to go up onto the guide inclined surfaces regardless of the inclined condition of the flexible arm.

Referring here to the front and back positional relationship between the guide projections and guide inclined surfaces, it is not always necessary that the front surface must be the upper surface and the back surface must be the lower surface, but the positional relationship is relative according to the engagement relationship between the securing projection and push-back spring. For example, referring to the upper and lower relationship between them, even if the guide projections are arranged so as to slide along the lower surface of the guide inclined surfaces, when the flexible arm is inclined toward one connector housing such that the securing projection of the flexible arm can be secured to the push-back spring, this operation is described herein as "the guide projections go up onto their respective guide inclined surfaces."

Also, in the invention as structured in the above-mentioned manner, since the guide projections are respectively provided on the flexible arm which can be driven in a flexing manner, while the guide inclined surfaces are respectively formed in the mating connector housing which stands still, it is possible to employ a compact flexible arm including only the projections. That is, in operation, the compact flexible arm may be inclined or driven.

Further, in the invention as structured in the above-mentioned manner, one connector housing includes the hood portion and stores or supports the push-back spring in the peripheral surface of the hood portion, while the other connector housing is structured such that it can be inserted into the hood portion. Also, the other connector housing not only includes a space in the portion thereof facing to the push-back spring but also supports the flexible arm in this space. Therefore, if the other connector housing is inserted into the hood portion of one connector housing, then the flexible arm supported in the space formed in the hood portion of the other connector housing is inclined by the engaging mechanism into a given inclined state, so that the flexible arm can be made to face the push-back spring supported in the peripheral wall of the hood portion and thus can be secured to the push-back spring or removed from the secured condition, or can be pushed back by the reaction of the push-back spring or can be removed from such push-back action.

Still further, in the invention as structured in the above-mentioned manner, in the connector pull-out operation, when the guide projections respectively pass under the inclined surfaces, the flexible arm can be flexed more greatly than it can be flexed to the full in the initial stage of the connector fitting operation. That is, such degree of flexing that the flexible arm is flexed as much as possible in the initial stage of the connector fitting operation is not enough to allow the guide projections to go under their respective guide inclined surfaces, so that the guide projections are sure to go up onto the guide inclined surfaces in the initial stage of the connector fitting operation.

To attain the above object, according to the third aspect of the invention, there is provided a spring storage mechanism which includes: a spring including a pair of front and rear side lateral parts arranged substantially in parallel to each other, and a pair of longitudinal parts respectively connecting the front and rear side lateral parts with each other, each of the longitudinal parts including a substantially U-shaped curved portion projected out backwardly of the rear side lateral part; and, a storage case formed in a substantially cylindrical body having a closed bottom and an opened rear end and capable of storing the spring therein, the storage case including in the inner peripheral wall thereof on the rear end opening side thereof a lance formed in an arm shape and including a wedge-shaped projection provided on and projected from the inner peripheral surface thereof so as to be securable to the rear side lateral part.

Also, in a spring storage mechanism as mentioned above, the spring is formed in a bilaterally symmetrical shape. Further, the lance is exposed to the outer peripheral surface of the spring storage case.

According to the invention as structured in the above-mentioned manner, the longitudinal parts connecting the pair of front and rear lateral parts respectively serving as a fulcrum and a point of action respectively include the curved portions which project out backwardly of the rear side lateral part and, if the spring is pushed into the spring storage case while the curved portions of the longitudinal parts thereof are being supported, then not only the front side lateral part but also the rear side lateral part are pushed into the spring storage case ahead of the curved portions and the rear side lateral part is secured to the lance.

Also, the spring means is formed in a bilaterally symmetrical shape and, while the curved portions projectingly provided in the right and left end portions of the longitudinal parts of the spring are being supported, the spring means is pushed into the spring storage case so that the central portions of the horizontal parts can be secured to the lance.

Further, the lance is exposed and, if the two lateral parts of the spring are moved through the lance in a process for storing the spring into the spring storage case, then the lance is pushed out externally and is returned back again. On the other hand, if the spring is not pushed in until the spring is moved beyond the lance, then the lance is left projected out externally.

DESCRIPTION OF PREFERRED EMBODIMENT

First Embodiment

Now, description will be given below of embodiments of a connector according to the first aspect of the invention with reference to the accompanying drawings.

Figure 1:
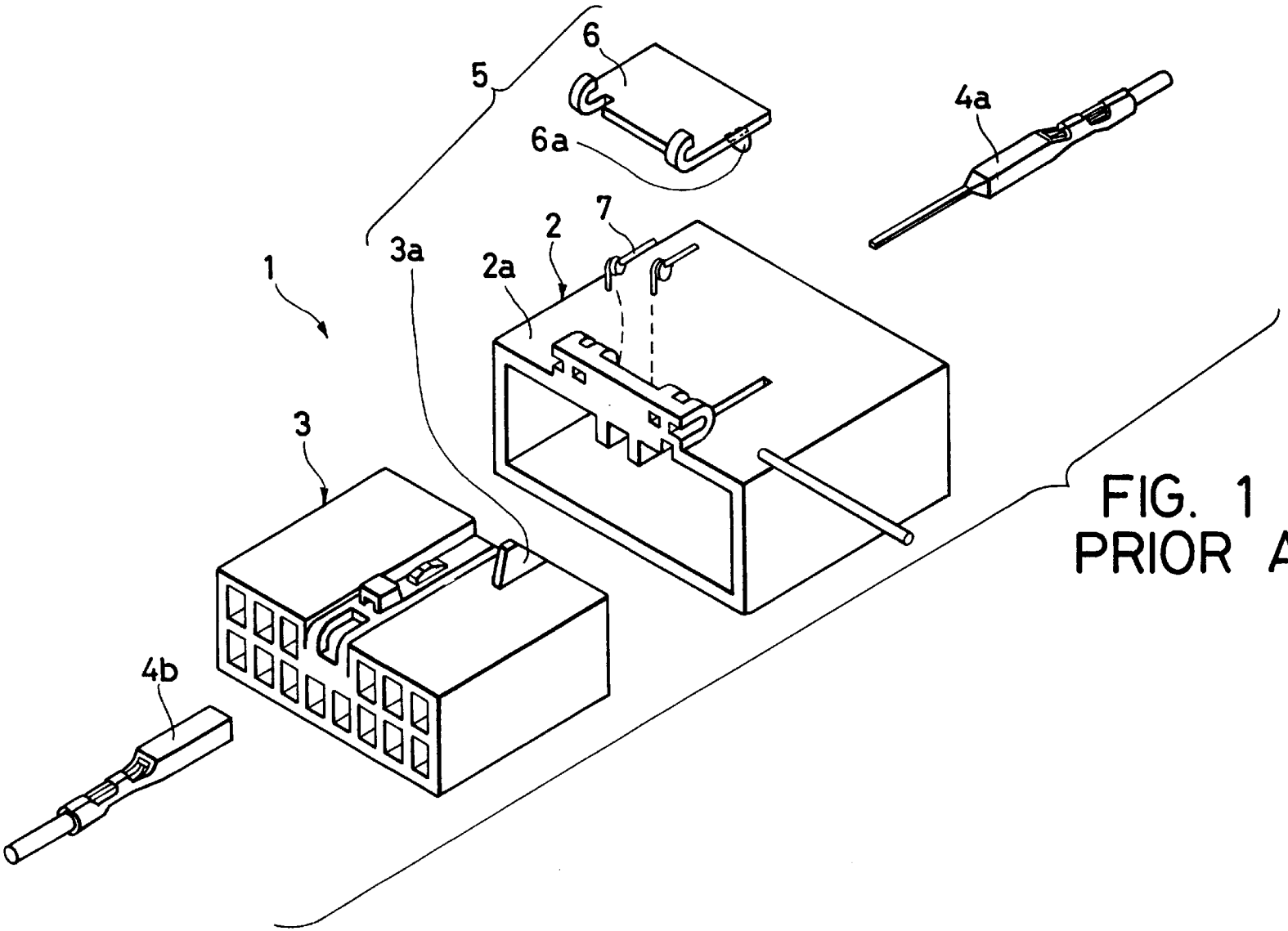
FIG. 1 PRIOR ART
FIG. 1 is an exploded perspective view of a conventional connector.
Figure 2:
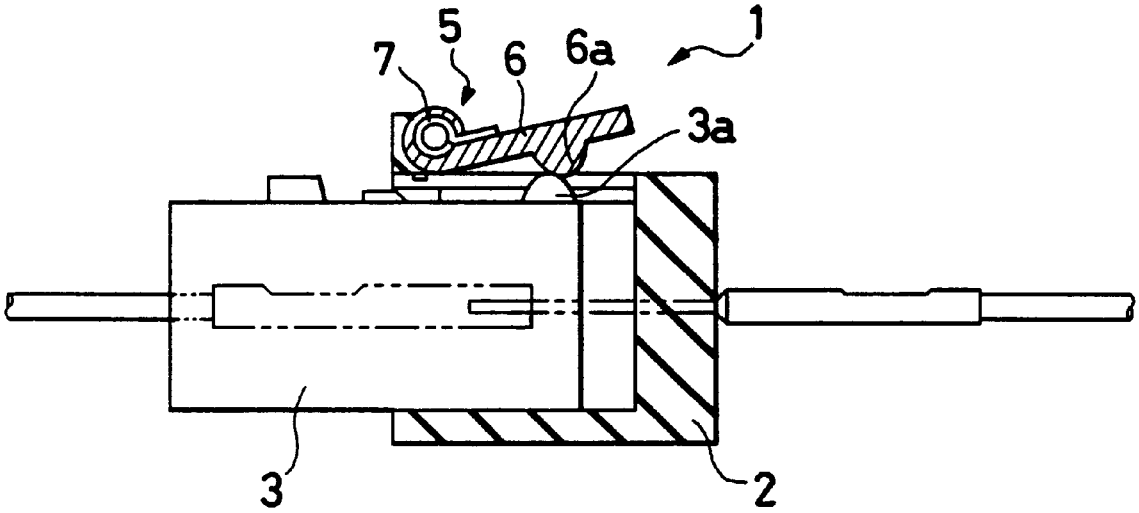
FIG. 2 PRIOR ART
FIG. 2 is a section view of the conventional connector when it is in a halfway fitted state.
Figure 3:
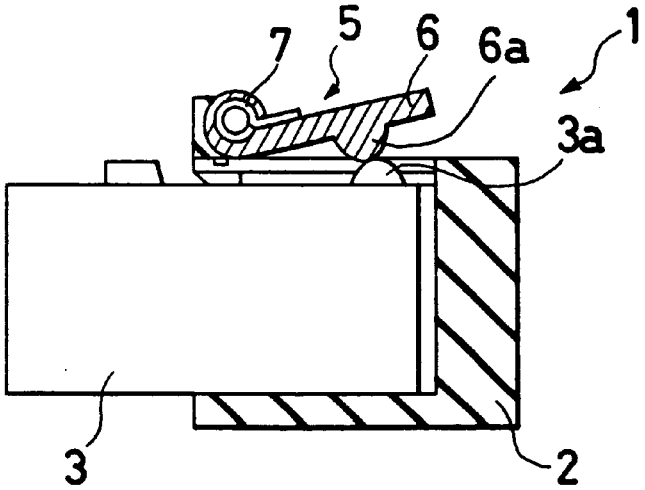
FIG. 3 PRIOR ART
FIG. 3 is a section view of the conventional connector when it is in a halfway fitted state.
Figure 4:
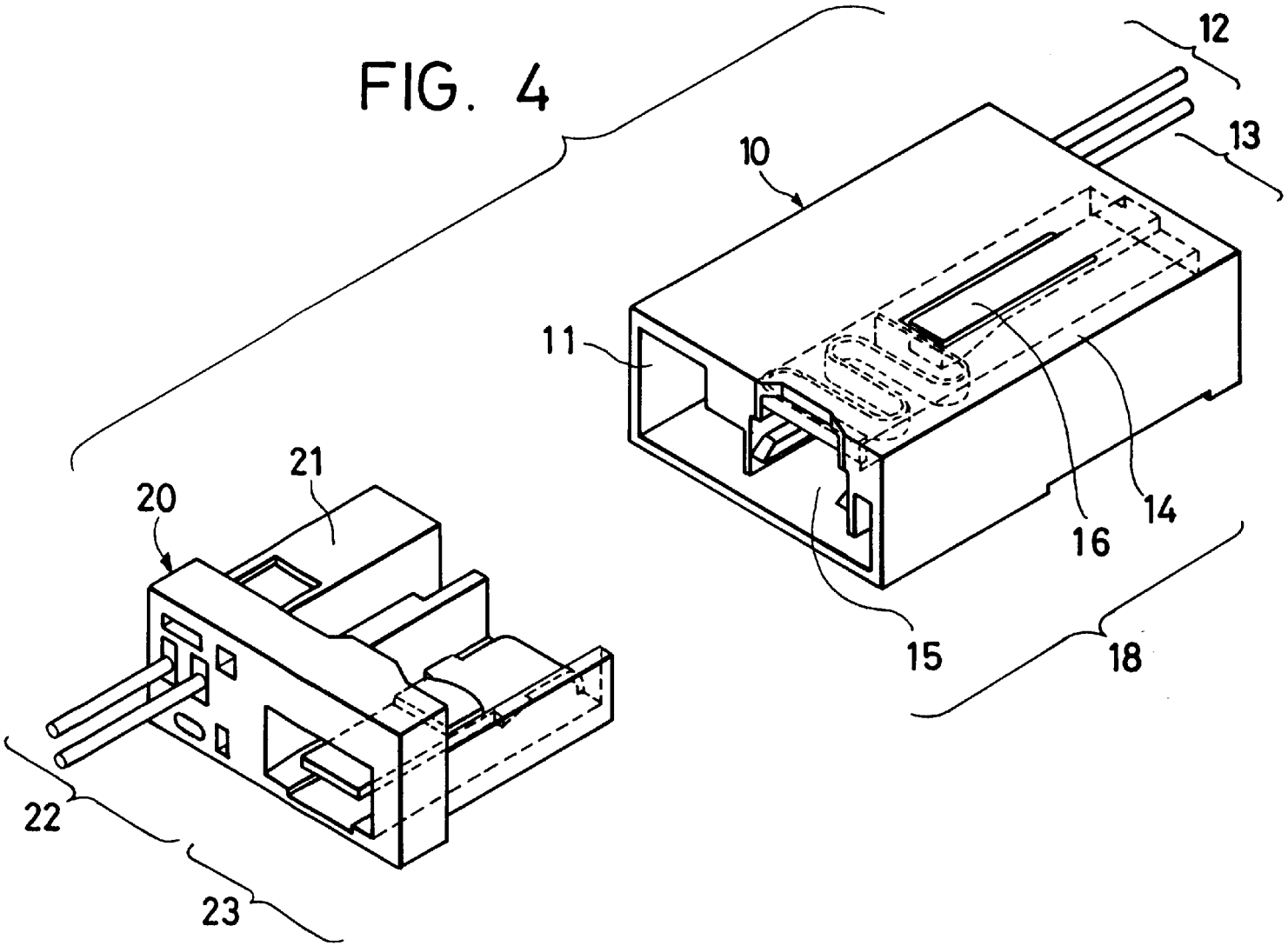
FIG. 4 is a perspective view of an embodiment of a connector according to the invention.

FIG. 4 is a perspective view of an embodiment of a connector according to the invention. In FIG. 4, a male side connector housing 10 for holding a male side terminal metal member (not shown) and a female side connector housing 20 for holding a female side terminal metal member fittable and connectable with the male side terminal metal member are fitted with and locked to each other to thereby form a connector, while the male side and female side connector housings 10 and 20 can be slided with respect to each other between a locked state and a separated state. Here, in the two connector housings 10 and 20, the mutually fitting surfaces sides thereof are respectively referred to as the front sides thereof.

The male side connector housing 10 includes an external shape which is formed as a wide rectangular parallelepiped, and also includes a front portion which is formed as a hood portion 11 having a space therein. Also, in the hood portion 11 of the male side connector housing 10, substantially the left half section thereof when the housing 10 is viewed from the front side thereof is formed as a terminal storage portion 12 for storing the female side terminal metal member, while the right half section thereof is formed as a mechanism portion 13 which, when the two connecting housings 10 and 20 are half fitted with each other, is arranged so as to exert a pull-back force or a push-out force.

On the other hand, the female side connector housing 20 is also formed in a wide rectangular parallelepiped as a whole and the front portion of the housing 20 is formed as an insertion portion 21 which can be inserted into the hood portion 11 of the male side connector housing 10. Also, the portion of the connector housing 20 that faces the terminal storage portion 12, in correspondence to the male side connector housing 10, is formed as a cylindrical terminal storage portion 22 for holding a female side terminal metal member (not shown) and, at the same time, the portion of the connector housing 20 facing the mechanism portion 13 is formed as a mechanism portion 23.

In the present embodiment, the male side and female side connector housings 10 and 20 are structured such that the areas thereof are respectively divided in the width direction thereof. However, the dividing direction and the dividing shape thereof can be appropriately changed depending on the situation. Also, it is not always necessary to divide them into two divisional sections but, for example, a single mechanism portion 13, 23 may be formed between the two terminal storage portions 12 and 22. Further, it is not always necessary to arrange the two connector housings 10 and 20 in the form of a wide rectangular parallelepipe but, for example, they may be arranged such that they have a square section or a polygonal section.

The mechanism portion 13 of the male side connector housing 10 stores therein a spring piece member 30 serving as an elastic member, whereas the mechanism portion 23 of the female side connector housing 20 includes a seesaw type lever piece member 40 serving as a lever piece member. Also, the two mechanism portions 13 and 23 cooperate with each other in forming a contact mechanism which is able to incline the seesaw type lever piece member 40.

Figure 14:
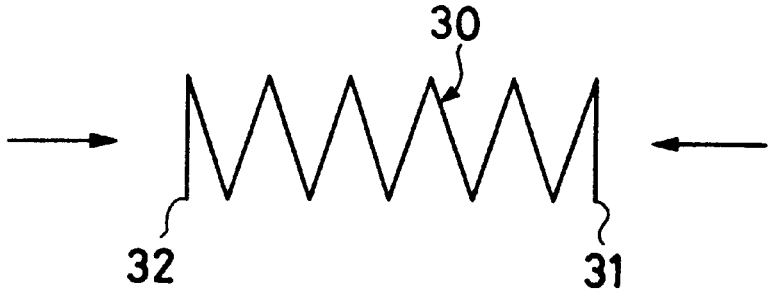
FIG. 14 is a plan view of an embodiment of a spring piece member employed in the invention.

The spring piece member 30 is formed of a long, narrow, and thin spring steel which is bent in a bellows manner, and the spring piece member 30 is stored within the mechanism portion 13 of the male side connector housing 10 and, in particular, in a hold mechanism 18 formed in the portion of the mechanism portion 13 that is situated on the upper surface side of the hood portion 11. The spring piece member 30 is structured such that, as shown in FIG. 14, it can be flexed in directions to compress or extend the bellows to thereby exert a resilient force, and also the two end portions 31 and 32 of the spring piece member 30 are bent at right angles with respect to the flexing direction of the spring piece member 30 so that, when the spring piece member 30 is compressed, it is easy to receive the compression force in the flexing direction thereof. Due to the fact that the elastic member of the spring piece member 30 is structured such that it can be compressed from the two directions, a supporting space for supporting the elastic member can be made equal to or less than the natural length of the elastic member. Also, the lever piece member is disposed in the same direction as the elastic member and is engageable with the two end portions of the elastic member within a small inclining operation range. Thanks to this structure, a mechanism capable of exerting a pull-back resilient force and a push-out resilient force can be formed in a small space.

Figure 15:
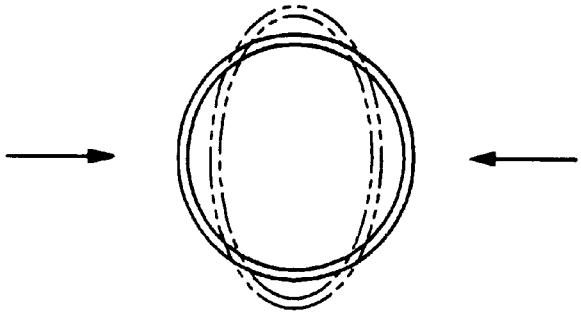
FIG. 15 is a plan view of a modification of a spring piece member employed in the invention.
Figure 16:
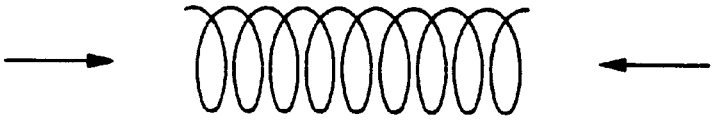
FIG. 16 is a plan view of a further modification of a spring piece member employed in the invention.

In the present embodiment, the spring piece member 30 is formed of a steel spring having a bellows-like shape but this is not limitative. For the spring piece member, there are available any other shapes, provided that they can provide a resilient force. For example, as shown in FIGS. 15 and 16, the spring piece member may be formed in a ring shape or in a coil shape. Also, for the material of the spring piece member, there can be employed any other materials than metal such as spring steel, provided they have a resilient force. For example, rubber or urethane can also be used.

The hold mechanism 18 for storing the spring piece member 30 therein includes a thin box-shaped spring storage chamber 14 formed so as to be opened backwardly on the upper surface of the mechanism portion 13 and capable of storing the spring piece member 30 therein, a communication window 15 formed about halfway in the width direction of the spring storage chamber 14 so as to extend from the front surface of the spring storage chamber 14 in such a manner that it is in communication with the mechanism portion 13 side, and a securing arm piece member 16 including an upper surface wall surface cut out into a U-shape so as to be superimposable on the rear end portion of the communication window 15 formed in the spring storage chamber 14, and also including in the leading end of the inside arm piece thereof a wedge-shaped projection 16*a* which projects out into the spring storage chamber 14, so that, when the spring piece member 30 is stored, the securing arm piece member 16 can be secured to the rear end of the spring piece member 30. Therefore, when the spring piece member 30 is inserted into the spring storage chamber 14 from the rear side opening thereof, then the spring piece member 30 advances while pushing up the projection 16*a* of the securing arm piece member 16 and, when the rear end of the spring piece member 30 moves beyond the projection 16*a*, the securing arm piece member 16 is returned back to its original position so that the spring piece member 30 can be secured by the securing arm piece member 16. Here, not only because the spring piece member 30 is held in such a manner that it is held in a slightly compressed condition in this state, but also because the securing arm piece member 16 is in such a positional relationship that it is superimposed on the rear end of the communication window 15, the spring piece member 30 is exposed wholly, that is, from the front end thereof to the rear end thereof through the communication window 15, so that it can be compressed through the communication window 15 from the two sides of the sliding direction of the two connector housings.

The spring storage chamber 14 includes on the lower surface thereof a pair of wall elements which are respectively formed so as to hang down from the lower surface of the spring storage chamber 14 and are opposed to each other with the communication window 15 in between and, on the respective inner surfaces of the two wall elements, there are provided waiting side guide projection pieces 17 and 17 which are respectively composed of a projecting strip disposed in the sliding direction of the connector housings. And, each of the receiving side guide projection pieces 17 includes upper and lower surfaces which are respectively formed as upper and lower flat surfaces 17*a* and 17*b*. Also, the front surface of the guide projection piece 17 is formed as a forwardly inclined surface 17*c* which descends gently from the front end of the upper flat surface 17*a* and is connected with the lower flat surface 17*b*, while the rear surface of the guide projection piece 17 is composed of a contact surface 17*e* hanging down perpendicularly from the rear end of the upper flat surface 17*a* as well as a downwardly inclined surface 17*d* descending gently from the lower end of the contact surface 17*e* while it is inclined slightly in the forward direction.

While being held by and between the two waiting side guide projection pieces 17 and 17, the seesaw type lever piece member 40 arranged in parallel to the connector housing sliding direction is projected into the mechanism portion 23 from the bottom surface inner wall thereof and, on the two side surfaces of the seesaw type lever piece member 40, there are provided a pair of movable side guides 45 and 45 which are respectively formed in a wedge-formed projection shape and also which are engageable with the waiting side guide projection pieces 17 and 17 to thereby provide an inclining guide mechanism.

The seesaw type lever piece member 40 includes a flexible support portion 41 formed so as to stand erect from the bottom surface inner wall thereof, and free end portions V and 42*b* respectively extended horizontally in the forward and backward directions from the upper end of the support portion 41. And, the movable side guides 45 and 45 are respectively formed at such height positions where they can face the receiving side guide projection pieces 17 and 17 on the two side surfaces of the free end portion 42*b* situated slightly to the rear of the support portion 41 of the seesaw type lever piece member 40. Also, the upper surface of each of the movable side guides 45 and 45 is formed as a flat surface, while the rear surface thereof provides a contact surface 45*b* which extends substantially in the vertical direction. Further, the movable side guides 45 respectively include gently inclined surfaces 45*a* and 45*a* which respectively extend from the front ends of the movable side guides 45 to the lower rear ends thereof. In this structure, during the sliding motion of the two connector housings, if the movable side guides 45 and 45 are moved in the vertical direction along the peripheral surfaces of the receiving side guide projection pieces 17 and 17, then the seesaw type lever piece member 40 with the present movable side guides 45 and 45 can be inclined in the forward or backward direction.

Here, the rear end side portion of the rear free end portion 42*b* that is situated rearward of a contact piece 44 is formed as an operation portion 46. That is, by actuating this operation portion 46, the seesaw type lever piece member 40 can be pressed down from the back surface of the female side connector housing 20.

The seesaw type lever piece member 40 is structured such that it is substantially parallel to the spring piece member 30 when it is held in the horizontal state and, on the upper surfaces of the free end portions 42*a* and 42*b* thereof, there are provided contact pieces 43 and 44 which respectively project upwardly. The two contact pieces 43 and 44 are respectively arranged at such a height position that, when the free end portions 42*a* and 42*b* are held in the horizontal state, the contact pieces 43 and 44 are able to advance into the communication window 15 but cannot be engaged with the spring piece member 30. However, when the seesaw type lever piece member 40 is inclined in the forward or backward direction, one of the two contact pieces 43 and 44 respectively situated forward and rearward of the support portion 41 is gradually raised up so that it can pass through the communication window 15 and finally arrive at a position where it can be superimposed on top of the spring piece member 30. As a result, the present contact piece can contact the spring piece member 30 during the sliding motion of the connector housings. By the way, the front contact piece 43 is arranged such that, when the male side connector housing 10 and female side connector housing 20 are in the mutually locked state, it is positioned so as to face the rear side end portion 32 situated in the rear end portion of the spring piece member 30, while the rear contact piece 44 is arranged such that, when the male side and female side connector housings 10 and 20 start to be fitted with each other, it is positioned so as to face the front side end portion 31 situated in the front end portion of the spring piece member 30.

That is, when the male side and female side connector housings 10 and 20 are made to face each other and are slid in order to switch them from the separated state over to the locked state, the front inclined surface 45*a* of the movable side guide 45 contacts the front inclined surface 17*c* of the receiving side guide projection piece 17, so that the movable side guide 45 is pushed up and guided to the upper flat surface 17*a*. As a result of this, the seesaw type lever piece member 40 is inclined in the forward direction and the rear contact piece 44 is thereby raised up and is brought into contact with the front side end portion 31 of the spring piece member 30. While keeping this state, if the two connector housings are slid further on, then the spring piece member 30 is compressed in the backward direction and, as a reaction to this backward compression of the spring piece member 30, the female side connector housing 20 receives a force which is going to push it out from the male side connector housing 10. However, when the female side connector housing 20 is inserted deep into the male side connector housing 10, then the movable side guide 45 passes through the upper flat surface 17*a* and thus the seesaw type lever piece member 40 is returned back to its original horizontal state due to the flexible property of the support portion 41, so that the contact surface 45*b* of the movable side guide 45 and the contact surface 17*e* of the receiving side guide projection piece 17 can be opposed to and fitted with each other. Also, since the contact piece 44 of the lever piece member 40 is moved downward when the lever piece member 40 is returned back to the horizontal state, the contact of the contact piece 44 with the spring piece member 30 is removed so that the flexed state of the spring piece member 30 is also released.

On the other hand, when the male side and female side connector housings 10 and 20 are to be switched from the locked state over to the separated state, by pressing down the operation portion 46 of the seesaw type lever piece member 40 until the contact piece 43 on the free end portion 42*a* is engaged with the rear side end portion 32 of the spring piece member 30, the locked state of the connector housings can be removed. If the locked state of the connector housings is removed and they are slid in the separating direction, then the spring piece member 30 is compressed in the forward direction and, as a reaction to this forward compression of the member 30, the female side connector housing 20 receives a force to pull it back to the male side connector housing 10. During this operation, the movable side guide 45 is slided into contact with the lower flat surface 17*b* of the receiving side guide projection piece 17 and, when the male side and female side connector housings 10 and 20 are completely switched over to the separated state, the movable side guide 45 also passes through the lower flat surface 17*b*, with the result that the seesaw type lever piece member 40 is allowed to return back to its horizontal state due to the flexing property of the support portion 41. Also, because the contact piece 43 is moved downward when the seesaw type lever piece member 40 returns back to its horizontal state, the contact of the contact piece 43 with the spring piece member 30 is removed to thereby release the flexed state of the spring piece member 30 as well.

Figure 17:
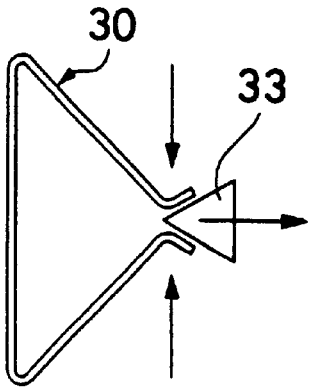
FIG. 17 is a plan view of a still further modification of a spring piece member employed in the invention.

In the present embodiment, in the sliding movements of the male and female connector housings which are respectively carried out in the fitting and locking operation and in the separating operation, the elastic member or the spring piece member 30 acts on the connector housings in such a manner that it pushes them out from each other as well as it pulls them back toward each other. However, this is not limitative but the elastic member may be arranged such that it can apply only the pull-back force to the connector housings. In this case, the elastic member may be adapted such that it does not apply any force onto the connector housings in the fitting and locking operation. For example, as shown in FIG. 17, if the elastic member or the spring piece member 30 is structured such that the direction of the resilient force thereof can be changed by combining a triangular contact member 33 with the forked spring arms of the spring piece member 30, then it is true that the spring piece member 30 applies a push-out force up to a certain stage, but, at a time when the force exceeds a given critical point, the force is removed suddenly. Of course, as in the present embodiment, if the spring piece member 30 is structured such that it can exert two kinds of forces which are respectively produced as reactions against the operation forces respectively to be applied to the connector housings in the two directions, then it is always possible to prevent the connector housings from being half fitted with each other, so that the operationability of the connector can be improved further.

Also, as a mechanism for exerting a pull-back force or a push-out force in this manner, there are available various kinds of mechanisms, provided that they can act in the above-mentioned manner. That is, it is not always necessary to employ such a structure as in the present embodiment in which the spring piece member 30 is supported at an upper position, the forwardly and backwardly inclinable seesaw type lever piece member 40 is disposed below the spring piece member 30, and the lever piece member 40 can be inclined by the inclining guide according to the sliding motion of the connector. However, if there is employed the above-illustrated structure in which, basically, while the contact pieces 43 and 44 are in contact with the resilient member such as the spring piece member 30, the elastic member is flexed; and, at the same time when the fitting operation or separating operation is completed, the contact between the contact pieces and elastic member is removed, then the structure of the connector can be truly simplified.

On the other hand, in the present embodiment, the spring piece member 30 is stored in the spring storage chamber 14 formed in the upper surface of the mechanism portion 13, whereby the spring piece member 30 is stored in such a manner that the flexing direction of the elastic member or spring piece member 30 is coincident with the sliding direction of the connector. However, this is not limitative but the method for storing the spring piece member 30 can be changed properly according to the shape of the spring piece member 30. That is, the spring piece member 30 may be stored in such a manner that the flexing direction thereof is not coincident with the sliding direction of the connector, or the spring piece member 30 storing position may not be adjacent to the mechanism portion 13. However, if the spring piece member 30 is disposed such that the flexing direction hereof is coincident with the sliding direction of the connector, then the spring piece member 30 can be flexed according to the sliding motion of the connector only by providing a simple mechanism which allows the contact pieces 43 and 44 to be moved and engaged with the spring piece member 30. Of course, when a torsion spring is used in place of the spring piece member 30, the torsion spring may be disposed in such a manner that the contact pieces 43 and 44 can be engaged with the end portions of the torsion spring. Also, although the spring piece member 30 is supported in such a manner that it can be compressed from both sides in the sliding direction of the connector, it has only to exert such a force as can move the connector in the sliding direction thereof, that is, it is not always necessary that the spring piece member 30 is able to apply its force in both of the two directions. However, as in the present embodiment, if the spring piece member 30 is structured so as to be able to exert its force in the two directions, then not only both of the pull-back and push-out forces for the mechanism portion 13 can be exerted by the same or single spring piece member 30, but also the spring piece member 30 can be compressed from both directions, so that the elastic member or the spring piece member 30 can be stored in a small space.

Also, in the present embodiment, although there is used a lever piece member structured in a seesaw type such as the seesaw type lever piece member 40, according to the invention, it is also possible to use a cantilever type lever piece member, or another movable piece may be prepared and, at a given time, the movable piece may be mounted on the spring piece member 30. However, in fact, if the lever piece member is structured in a seesaw type, then the seesaw type lever piece member can be easily engaged with the spring piece member 30 from both front and behind simply by changing the inclining direction of the seesaw type lever piece member, so that the connector can made compact.

Further, in the present embodiment, the inclining mechanism to incline the seesaw type lever piece member 40 supporting the contact pieces 43 and 44 in the above-mentioned manner is composed of the movable side guide 45 provided on the side surface of the seesaw type lever piece 40, and the waiting side guide projection piece 17 provided on the side surface of the mechanism portion 13 of the male side connector housing 10 into which the seesaw type lever piece member 40 can be inserted. However, this is not limitative but the inclining mechanism can be freely changed to any other type of mechanism such as a cam mechanism, an uneven or undulated mechanism, or the like, provided that it is able to incline the lever piece member into a given inclined state.

Second Embodiment

Still further, in the present embodiment, the two contact pieces 43 and 44 respectively formed in the seesaw type lever piece member 40 can be engaged directly with the spring piece member 30. However, this is not limitative but, for example, as shown in FIGS. 10 to 13, an engaging piece 50 may be interposed between the contact pieces and the lever piece member. In this case, instead of holding the rear end of the spring piece member 30 by means of the securing arm piece 16 provided in the upper surface of the spring storage chamber 14, the rear end of the spring piece member 30 is held by the engaging piece 50 that is supported slidably, while the engaging piece 50 is prevented against removal by the lock arm 19 provided in the rear end portion of the male side connector housing 10. Since the contact piece 43 is provided in the seesaw type lever piece member 40, it is greatly restricted in shape, so that the best shape of the contact piece 43 to be ideally secured to the spring piece member 30 cannot be always selected. However, due to the above-mentioned interposition of the engaging piece 50, if one end portion of the engaging piece 50 is arranged as the best shape for securing to the spring piece member 30 and the other end portion thereof is formed in a shape easy to secure to the contact piece 43, then the contact piece 43 can be well engaged with and disengaged from the spring piece member 30.

Next, description will be given below of the operation of the present embodiments having the above-mentioned structure.

Figure 5:
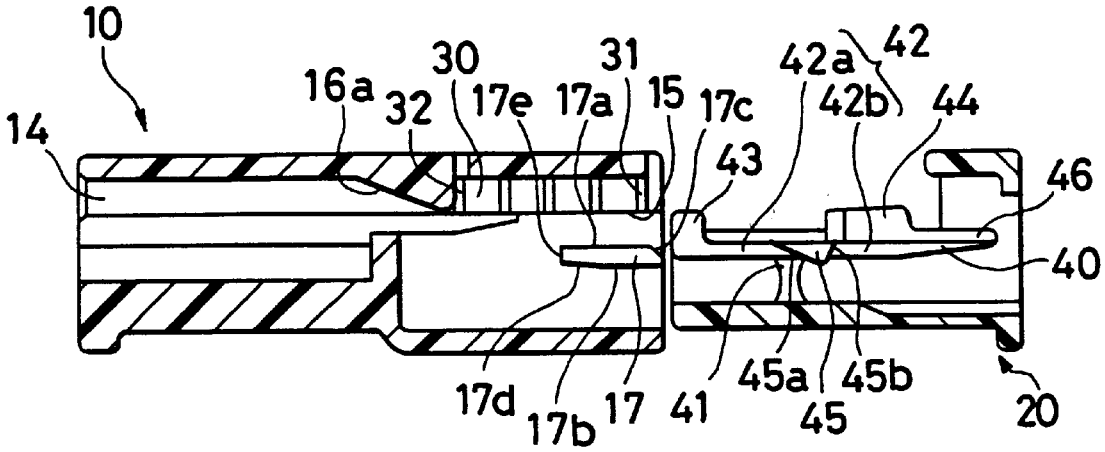
FIG. 5 is a section view of the connector when it is in a separated state.
Figure 6:
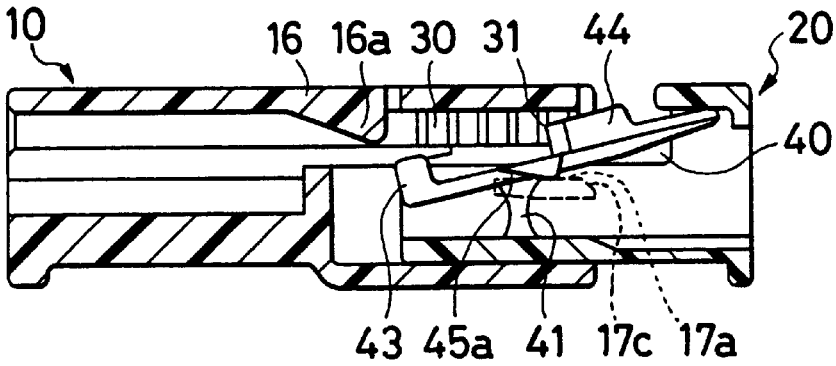
FIG. 6 is a section view of the connector when it is in a locked state.

As shown in FIG. 5, the fitting surfaces of the male side and female side connector housings 10 and 20 are made to face each other in a mutually separated state and, from this separated state, the male side connector housing 10 is slided forwardly. As a result of this, the front inclined surface 45*a* of the movable side guide 45 moves onto the front inclined surface 17*c* of the waiting side guide projection piece 17 and inclines the seesaw type lever piece member 40 against the flexibility of the support portion 41, so that the contact piece 44 provided in the rear of the upper surface of the seesaw type lever piece member 40 can be brought into engagement with the front surface side end portion 31 of the spring piece member 30. If the female side connector housing 20 is slided further forwardly, then the contact piece 44 compresses the spring piece member 30 on the back side thereof, thereby causing the spring piece member 30 to exert a resilient force which pushes out the female side connector housing 20 toward the separated state.

At the then time, the terminal metal members respectively held in the male and female connector housings are connected with each other in a half fitted state and, in this state, if the operator takes off his or her hands from the connector, then the female side connector housing 20 is pushed out from the male side connector housing 10, so that the two connector housings are switched over to the above-mentioned separated state and the two terminal metal members are also separated from each other completely.

Figure 7:
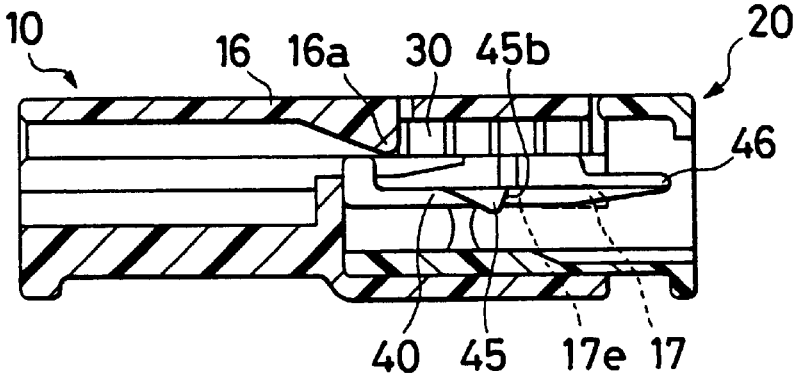
FIG. 7 is a section view of the connector when it is in the locked state.
Figure 8:
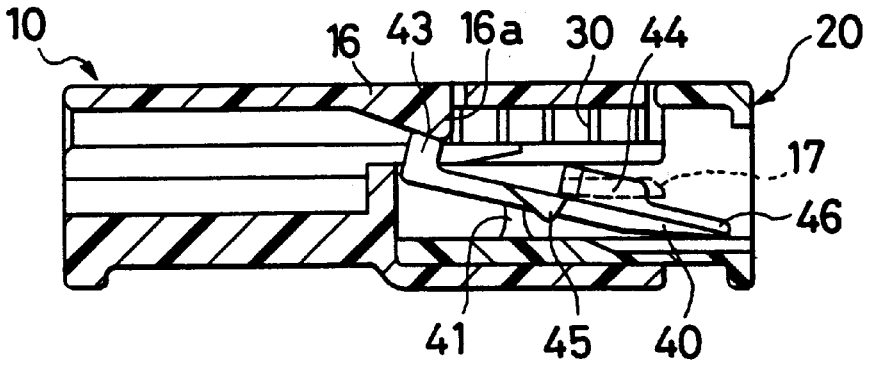
FIG. 8 is a section view of the connector when it is in a separation starting state.
Figure 9:
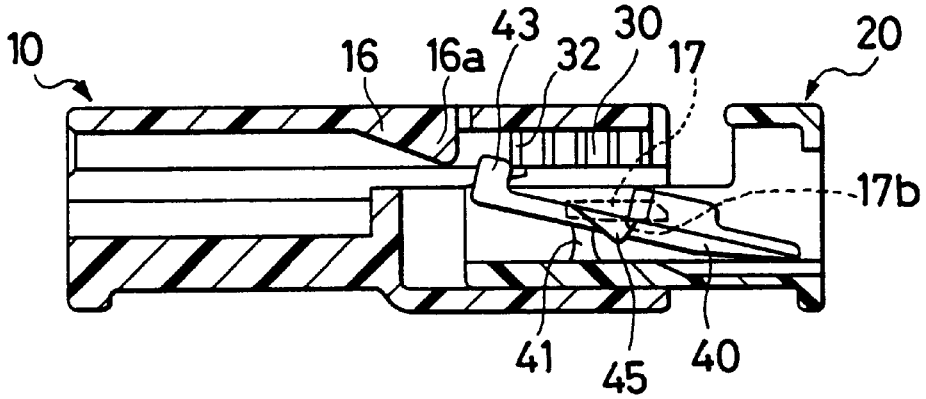
FIG. 9 is a section view of the connector when it is in a separating process.
Figure 10:
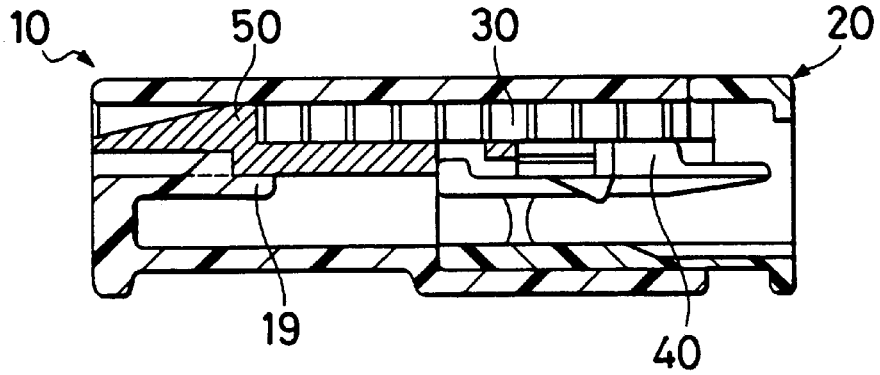
FIG. 10 is a section view of a modification of a connector according to the invention when it is in a locked state.
Figure 11:
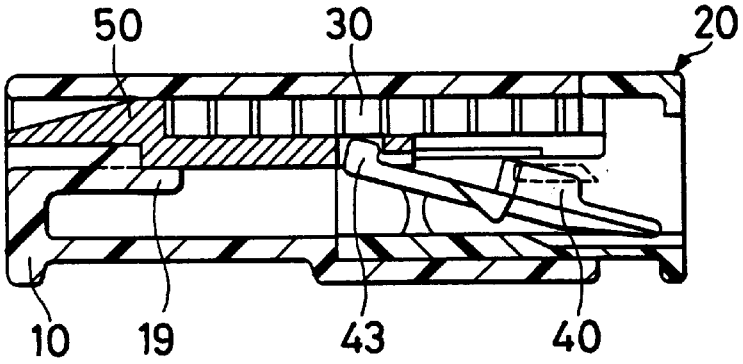
FIG. 11 is a section view of the modification when it is in a separation starting state.
Figure 12:
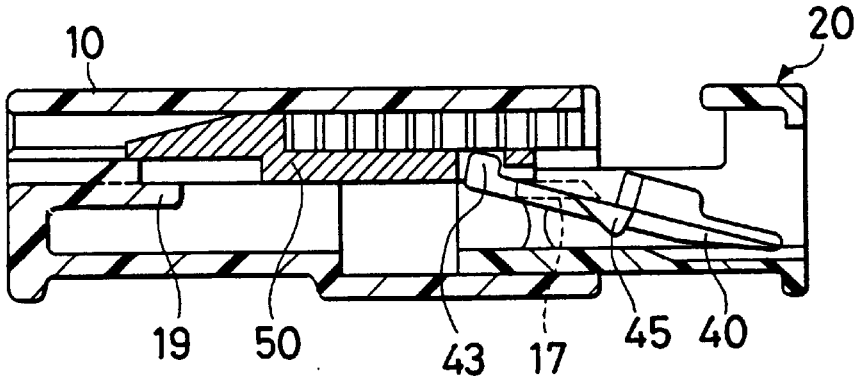
FIG. 12 is a section view of the modification when it is in a separating process.
Figure 13:
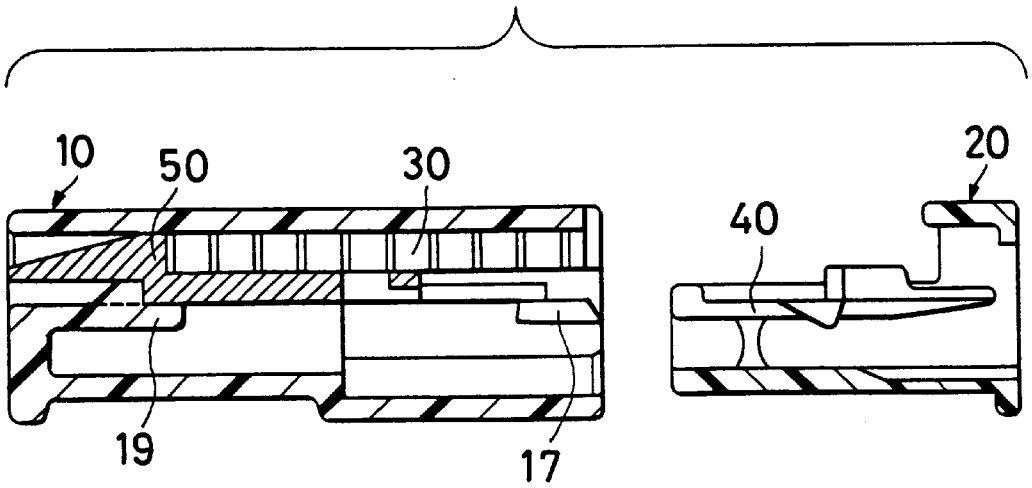
FIG. 13 is a section view of the modification when it is in a separated state.

If the male side connector housing 10 is slided further forwardly, then the movable side guide 45 passes through the waiting side guide projection piece 17 and the seesaw type lever piece member 40 returns to its original position, thereby removing the engagement between the contact piece 44 and spring piece member 30 as well as allowing the waiting side guide projection piece 17 to be arranged in the sliding direction of the connector, so that the two connector housings can be locked to each other. In this state, the two terminal metal members respectively held in the two connector housings are completely fitted with each other and the flexing of the spring piece member 30 is released at a stroke, thereby allowing the two connector housings to be fitted with and locked to each other with click feeling. In FIG. 7, there is shown the locked state of the two connector housings.

Next, description will be given below of an operation to slide the two connector housings from the above-mentioned locked state to the separated state.

Even if the operator simply tries to pull out the female side connector housing 20 from the locked state as it is, since the contact surface 45*b* of the movable side guide 45 on the rear end side thereof is in contact with the contact surface 17*e* of the waiting side guide projection piece 17, the female side connector housing 20 cannot be pulled out. Also, if the operator tries to pull out the female side connector housing 20 while the contact surface 45*b* is in contact with the contact surface 17*e*, then there is truly applied a force which is going to incline the seesaw type lever piece member 40 but, however, because the rear free end portion 42*b* is in contact with the spring piece member 30 and thus the seesaw type lever piece member 40 is prevented from inclining, the locked state of the connector cannot be removed.

To slide the female side connector housing 20 backwardly from the locked state of the connector, the operation portion 46 provided in the end portion of the seesaw type lever piece member 40 is pressed down to thereby incline the seesaw type lever piece member 40. As a result of this, the front free end 42*a* of the seesaw type lever piece member 40 is pushed up to thereby bring the contact piece 43 into engagement with the rear end portion 32 of the spring piece member 30. In this state, if the female side connector housing 20 is slided backwardly, then the contact piece 43 compresses the spring piece member 30 in the forward direction, so that the spring piece member 30 exerts a resilient force to pull back the female side connector housing 20 toward the fitted state.

At the then time as well, the two terminal metal members respectively held in the two connector housings are connected with each other in the half fitted state but, however, in this state, if the operator takes off his or her hands from the connector housings, then the female side connector housing 20 is pulled back toward the male side connector housing 10, so that the two connector housings 10 and 20 are fitted with and locked to each other as well as the two terminal metal members are also connected with each other again.

If the female side connector housing 20 is slided further backwardly, the movable side guide 45 passes through the waiting side guide projection piece 17 and the seesaw type lever piece member 40 returns to its original position, which removes the engagement of the contact piece 43 with the spring piece member 30 and releases the flexed state of the spring piece member 30 at a stroke, so that the connector is turned into the separated state shown in FIG. 5. In this operation as well, by releasing the flexed state of the spring piece member 30 at a stroke, the connector can be turned into the separated state moderately.

As has been described heretofore, according to the invention, the spring piece member 30 supported by the male side connector housing 10 is structured such that it can be compressed in the two directions of the connector sliding motion when the connector is mounted and removed, the seesaw type lever piece member 40 arranged so as to be seesawable in the sliding direction of the female connector housing 20 can be inclined forwardly and backwardly into engagement with the two end portions of the spring piece member 30, and the seesaw type lever piece member 40 can be inclined according to the fitted state of the connector by the waiting side guide projection piece 17 and movable side guide 45 respectively provided in the male side connector housing 10 and in the female side connector housing 20. Thanks to this structure, the resilient forces respectively to pull back and push out the two connector housings in the half fitted state thereof can be obtained from the same elastic member, that is, the same spring piece member 30, and thus the engagement and disengagement between the spring piece member and seesaw type lever piece member can be realized within a small operation range, which makes it possible to realize a compact, half fitted connector.

As has been described hereinbefore, according to the invention, since a pull-back force continues to act on the two connector housings without being interrupted until they are switched over to the separated state, it is possible to provide a connector which is prevented from being left in a half fitted state in the neighborhood of the reversing point of the repelling force or due to the shortage of the resilient force.

Also, as the elastic member is disposed along the sliding direction of the connector housings, simply by bringing the contact mechanism into engagement with the elastic member or by removing the engagement of the contact mechanism with the elastic member, the elastic member can be flexed or returned to its original condition, so that the structure of the connector can be simplified.

Further, because the lever piece member can be engaged with or disengaged from the resilient member simply by changing the inclined angle of the lever piece member, the structure of the connector including the guide mechanism for inclining the lever piece member can be simplified. Also, the present connector can be driven in a small operation range, so that the connector can be saved in space and thus can be made compact.

Still further, due to the fact that, in the connector housings separating operation, the same elastic member is flexed in one direction to thereby be able to obtain a pull-back resilient force and, in the fitting operation, it is flexed in the other direction to thereby be able to obtain a pull-out resilient force, it is possible to prevent the half fitted states of the two connector housings in both directions without increasing the number of parts.

Yet further, since a resilient force in a given direction can be easily obtained from the elastic member simply by inclining the lever piece member forwardly or backwardly, not only the connector can be simplified in structure, but also the space of the connector can be saved so that the connector can be made compact.

In addition, because the engaging piece is previously mounted on the resiliently deformable elastic member and the lever piece member can be engaged with the elastic member indirectly through the engaging piece, the engagement between the lever piece member and the elastic member can be achieved without fail.

Third Embodiment

Now, description will be given below of an embodiment of a connector according to second aspect of the invention with reference to the accompanying drawings.

Figure 18:
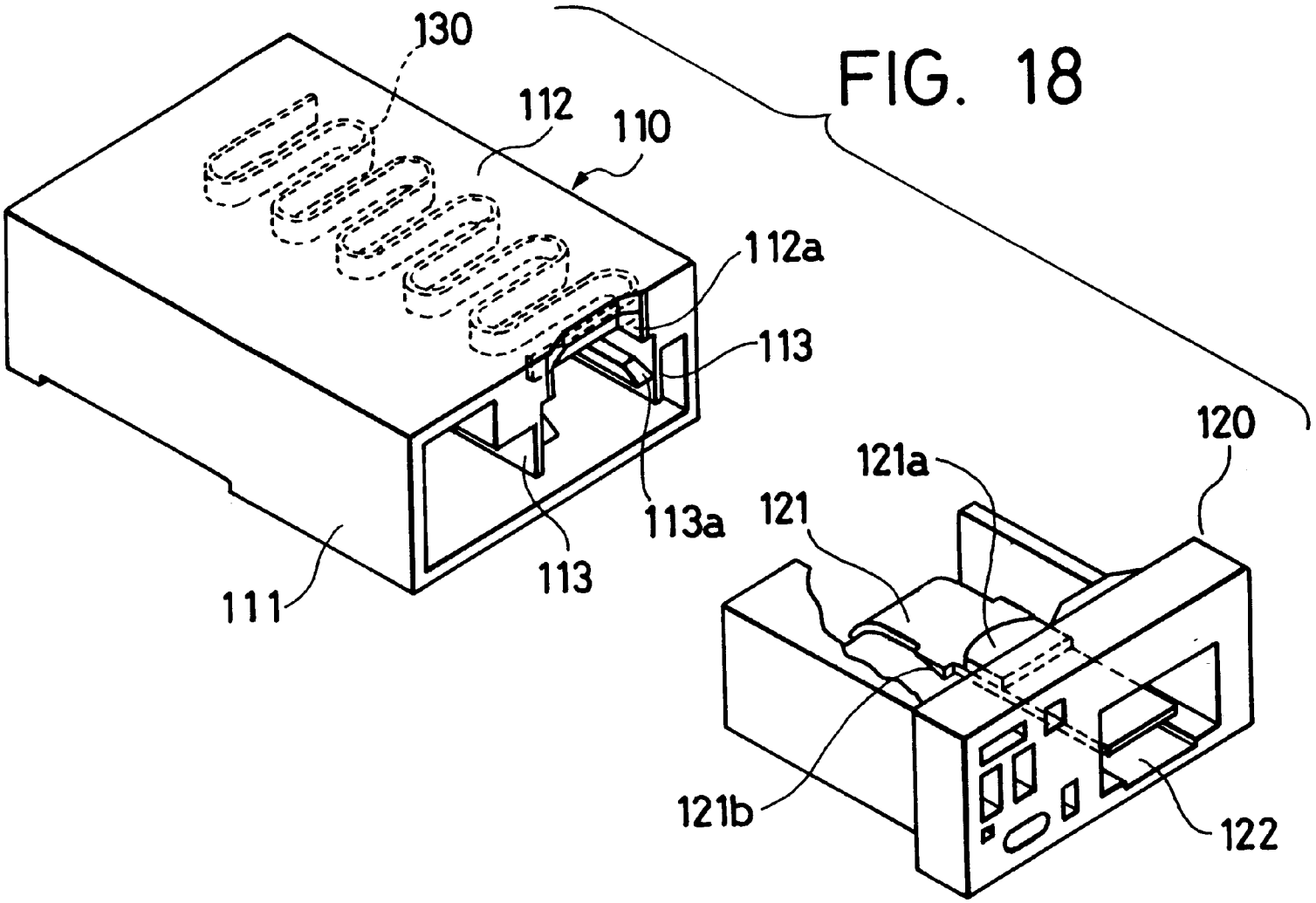
FIG. 18 is a perspective view of an embodiment of a connector according to the invention.

FIG. 18 is a perspective view of an embodiment of a connector according to the invention.

In FIG. 18, a male side connector housing 110 and a female side connector housing 120 respectively hold a male side terminal metal member and a female side terminal member and, if the leading end portion of the female side connector 120 is inserted into a hood portion 111 formed in the male side connector 110, then the two terminal metal members can be connected with each other and the two connector housings 110 and 120 can be thereby fitted and connected with each other. Also, the male side connector housing 110 stores a push-back spring 130 therein, while a flexible arm 121 formed integral with the female side connector housing 120 is pressed against the push-back spring 130 to compress it when the female connector housing 120 is inserted into the male side connector housing 110 so that the flexible arm 121 can receive a push-back force as the result of the reaction of the push-back spring 130.

In the present embodiment, a pair of mutually fittable and connectable connector housings store therein the male and female side terminal metal members respectively. However, it is not always necessary for the male and female connector housings to store therein the male and female side terminal metal members, but they may be structured such that they do not store therein such male side or female side terminal metal member, provided that the male and female side connector housings are capable of storing therein a pair of mutually conducting terminal metal members which are able to conduct with each other when the male and female side connector housings are made to approach toward each other and are then fitted and connected with each other. Also, in the present embodiment, although the push-back spring 130 is disposed in the connector housing which stores the male side terminal metal member and the flexible arm 121 is disposed in the connector housing which stores the female side terminal metal member, it is also possible to dispose them in the reversed manner.

The ceiling side of the hood portion 111 provided in the male side connector housing 110 is formed as a spring storage chamber 112 which can store therein the zig-zag bent push-back spring 130. The spring storage chamber 112 includes a communication window 112*a* which is open from the front surface side of the hood portion 111 toward the deep side of the inner peripheral surface of the hood portion 111 in such a manner that it is narrower in width than the push-back spring 130, a storage opening 112*b* which faces the rear surface of the male side connector housing 110 and is capable of storing the push-back spring 130 therein, and a wedge-shaped lock projection 112*c* provided on the inner peripheral wall surface of the spring storage chamber 112 on the side of the storage opening 112*b*, the lock projection 112*c* being securable to the push-back spring 130 in such a manner that it allows the push-back spring 130 to be pushed into the spring storage chamber 112 but prevents the push-back spring 130 from being removed from the spring storage chamber 112. That is, if the push-back spring 130 is inserted into the spring storage chamber 112 from the storage opening 112*b* situated in the rear side of the chamber 112, then the wedge-shaped lock projection 112*c* is flexed to thereby allow the push-back spring 130 to go beyond the lock projection 112*c* and, when the rear end of the push-back spring 130 moves beyond the wedge-shaped lock projection 112*c*, then the wedge-shaped lock projection 112*c* is returned back its original state to thereby lock the push-back spring 130 in such a manner that the push-back spring 130 is prevented against removal.

Here, in the present embodiment, although the spring storage chamber 112 is formed on the ceiling side of the hood portion 111, it is not limitative but the spring storage chamber 112 may be formed in either of the peripheral wall surfaces of the hood portion 111. For the sake of convenience, description will be given of a case in which the spring storage chamber 112 is formed on the upper side of the hood portion 111. However, even when the spring storage chamber 112 is formed on the bottom surface side thereof, the basic operation of the spring storage chamber 112 is similar. Also, in the present embodiment, as the push-back spring 130, a zig-zag bent spring is used. However, this is not limitative but it is also possible to use any other shape of spring such as a coil spring, a torsion spring or the like, provided that, when the female side connector housing 120 to be stored in the hood portion 111 is inserted thereinto, the spring can be pushed in and compressed by the flexible arm 121. Further, in order to hold the push-back spring 130 to prevent it against removal, instead of using the wedge-shaped lock projection 112*c*, the push-back spring 130 may be held by other methods, for example, the opening of the spring storage chamber 112 may be closed by a cover member.

Now, within the hood portion 111, there are provided a pair of guide walls 113 and 113 respectively projecting inwardly of the hood portion 111 in such a manner that they place the communication window 112 between them and, on the side surfaces of the hood portion 111 mutually opposed to the guide walls 113 and 113, there are provided a pair of guide inclined surfaces 113*a* and 113*a* respectively projecting substantially in parallel to each other in the insertion direction of the female side connector housing 120. On the other hand, while the female side connector housing 120 storing therein the female side metal member is formed in a substantially rectangular box shape, the portion of the female side connector housing 120 that corresponds to a space formed by and between the two guide walls 113 and 113 of the hood portion 111 of the male side connector housing 110 is formed as a recessed portion 122 which is opened upwardly, and the flexible arm 121 is structured such that it projects upwardly of the front end bottom surface of the recessed portion 122 and then extends backwardly. The flexible arm 121 is formed narrower in width than the two guide walls 113 and 113, includes on the rear end upper surface thereof a securing projection 121*a* which can be inserted into the spring storage chamber 112 through the communication window 112*a*, and also includes two wedge-shaped guide projections 121*b* and 121*b* respectively provided on the two side surfaces thereof. Also, the recessed portion 122 extends continuously up to the rear end thereof and the rear end of the flexible arm 121 is formed as a free end, so that the rear end of the flexible arm 121 can be pressed down when an operator removes the fitted state of the connector.

The two guide inclined surfaces 113*a*, 113*a* respectively formed in the two guide walls 113, 113 and the two guide projections 121*b*, 121*b* respectively provided on the side surfaces of the flexible arms 121 cooperate together in forming an engaging mechanism. When the opening side of the hood portion 111 of the male side connector housing 110 is assumed to be the front side thereof, the front side surfaces of the two guide inclined surfaces 113*a*, 113*a* respectively provide slanting surfaces which ascend toward the rear side thereof, the rear side surfaces thereof respectively provide substantially vertical walls, the upper surfaces thereof are substantially horizontal, and the lower surfaces thereof respectively provide slanting surfaces which descend slightly toward the front side thereof. On the other hand, when the sides of the guide projections 121*b*, 121*b* facing the hood portion 111 are assumed to the front sides thereof, the front portions of the guide projections 121*b*, 121*b* are sharpened, while the guide projections 121*b*, 121*b* each has a section which increases in thickness as it goes backwardly. Also, when the rear end of the flexible arm 121 is pressed down, the guide projections 121*b*, 121*b* are also moved downward. However, regardless of this downward motion, when the female side connector housing 120 is made to face the opening of the hood portion 111 of the male side connector housing 110, the leading ends of the guide projections 121*b*, 121*b* are to be situated above the corner portions of the leading ends of the guide inclined surfaces 113*a*, 113*a*.

Figure 19:
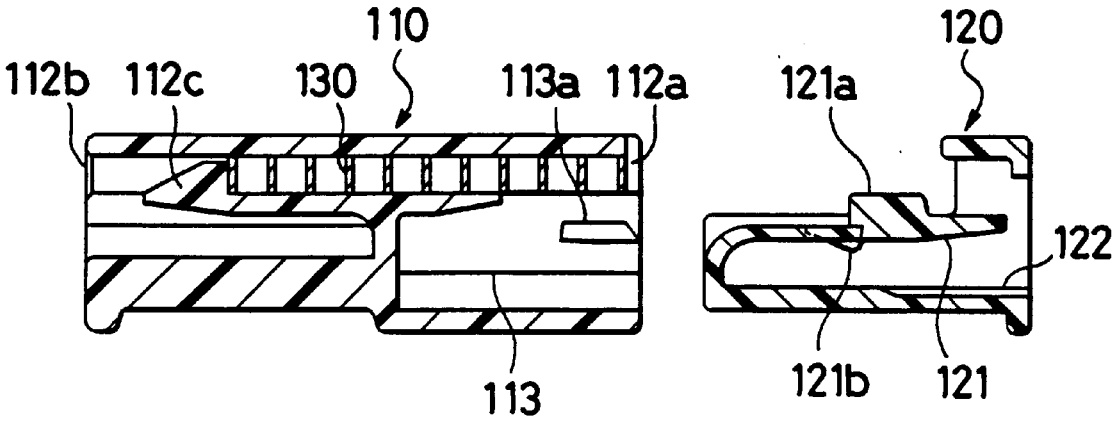
FIG. 19 is a section view of the connector before the connector fitting operation thereof is started.
Figure 21:
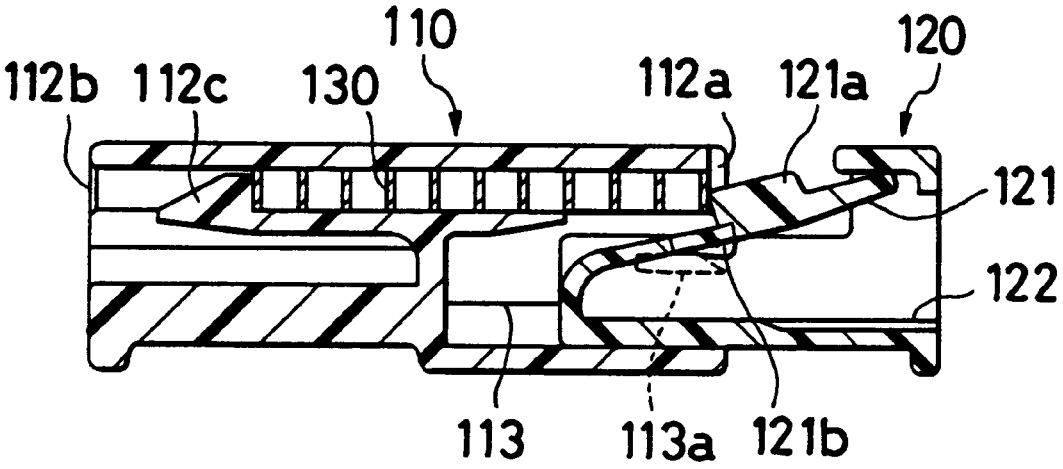
FIG. 21 is a section view of the connector during the connector fitting operation thereof.
Figure 22:
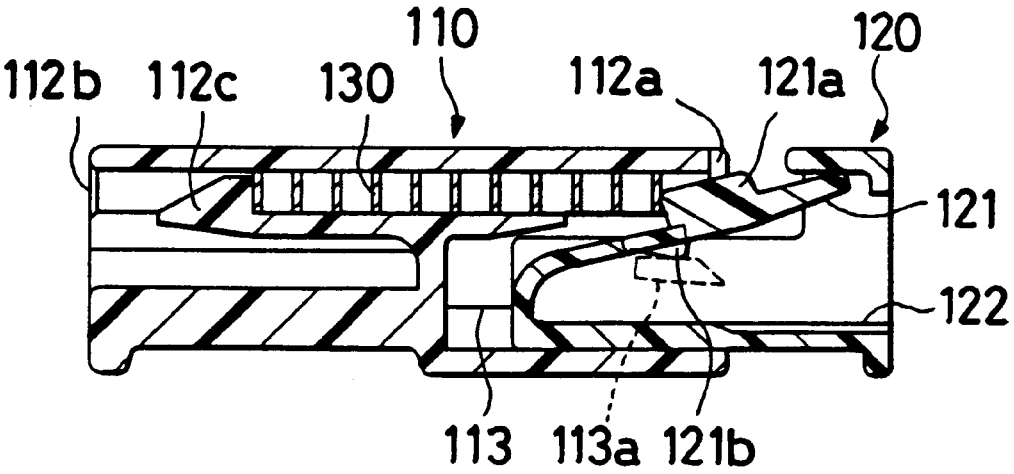
FIG. 22 is a section view of the connector during the connector fitting operation thereof.
Figure 23:
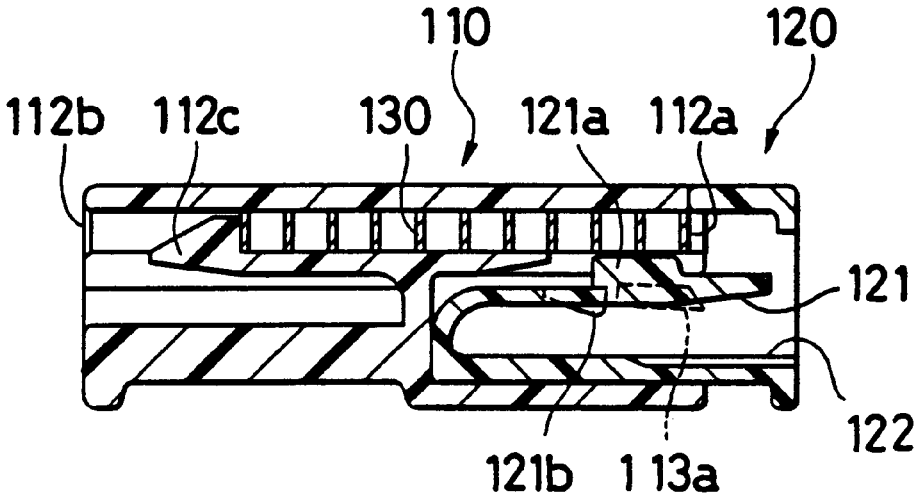
FIG. 23 is a section view of the connector after the connector fitting operation thereof is completed.

Thanks to this structure, if the female side connector housing 120 is inserted from a state shown in FIG. 19 into the hood portion 111 of the male side connector 110, then the guide projections 121*b*, 121*b* are respectively allowed to go up onto the upper surfaces of the guide inclined surfaces 113*a*, 113*a* as shown in FIG. 21, so that the flexible arm 121 is inclined in such a manner that the rear end thereof is raised upwardly. As a result of this, a securing projection 121*a* provided on the upper surface of the rear end portion of the flexible arm 121 is inserted into the spring storage chamber 112 through the communication window 112 formed in the ceiling surface of the hood portion 111 and is contacted with the front end of the push-back spring 130 stored in the spring storage chamber 112. In the connector fitting operation, as shown in FIG. 22, as the female side connector housing 120 is inserted into the hood portion 111, the housing 120 compresses the push-back spring 130, so that the female side connector housing 120 receives a force to push it back as the reaction of the push-back spring 130. And, as shown in FIG. 23, at the same time when the connector reaches a normal fitted state, the guide projections 121*b*, 121*b* go beyond the guide inclined surfaces 113*a*, 113*a* respectively, so that the flexible arm 121 returns to its original horizontal state. Since the securing projection 121*a* is also moved downwardly along with this return operation of the flexible arm 121, the secured state of the securing projection 121*a* to the push-back spring 130 is removed to thereby release the reaction of the push-back spring 130 and, in turn, the guide projections 121*b*, 121*b* are respectively opposed to the guide inclined surfaces 113*a*, 113*a* in their respective rear end faces thereof so that they are engaged or fitted with each other and are thereby prevented against removal.

Figure 24:
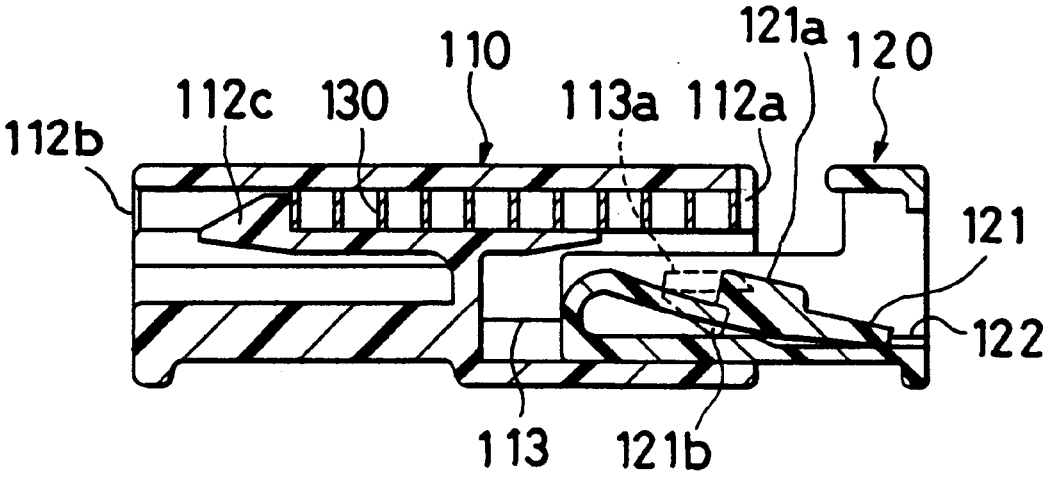
FIG. 24 is a section view of the connector during the connector pulling-out operation thereof.

On the other hand, in this fitted state, if the rear end of the flexible arm 121 is pressed down, then the upper side corner portions of the rear ends of the guide projections 121*b*, 121*b* are pressed down below the lower side corner portions of the rear ends of the guide inclined surfaces 113*a*, 113*a*, so that the engagement between the guide projections 121*b*, 121 and guide inclined surfaces 113*a*, 113*a* is removed. In this state, if the female side connector housing 120 is pulled out, as shown in FIG. 24, the guide projections 121*b*, 121*b* are then moved along and through the lower surfaces of the guide inclined surfaces 113*a*, 113*a*. In this operation, since the lower surfaces of the guide projections 113*a*, 113*a* are slightly inclined, while the guide projections 121*b*, 121*b* are being pulled out, they are pressed further downwardly, so that the flexible arm 121 is flexed in a bow shape with the rear end thereof pressed against the bottom surface of the recessed portion 122. This flexed state cannot be recovered only by pressing down the rear end of the flexible arm 121. If the female side connector housing 120 is pulled out further, then the guide projections 121*b*, 121*b* are moved along and through the lower surfaces of the guide inclined surfaces 113*a*, 113*a*, so that the flexible arm 121 is now allowed to return to its original state.

In the present embodiment, the engaging mechanism is formed by the guide projections 121*b*, 121*b* respectively provided on the two side surfaces of the flexible arm 121 and the guide inclined surfaces 113*a*, 113*a* which are respectively formed on the guide walls 113, 113 and face the guide projections 121*b*, 121*b* in such a manner that they place the flexible arm 121 between them. However, this is not limitative but any other type of engaging mechanism can also be employed, provided that it is able to incline the flexible arm 121 facing the push-back spring disposed along the insertion direction of the female side connector housing. Therefore, means like the guide inclined surface 113*a* may be formed on the side of the flexible arm 121 and means like the guide projection 121*b* may be formed on the side of the guide wall 113. Or, on the side of the flexible arm 121, there may be formed a slit-like cutaway portion and there may be provided similar inclined surfaces and projections on the inner surfaces of the cutaway portion; and, on the side of the male side connector housing 110, the guide wall 113 may be formed in such a manner that it can be inserted into the cutaway portion and, on the two side surfaces of the guide wall 113, there may be formed projections and inclined surfaces which respectively correspond to the inclined surfaces and projections of the cutaway portion. In these modifications, there is a possibility that the guide projections 121*b*, 121*b*, physically, cannot always go up onto the upper surfaces of the guide inclined surfaces 113*a*, 113*a* but can go under the lower surfaces thereof. However, the directions of the engaging mechanism including the upper, lower, right and left directions thereof must not be interpreted limitatively but the directions may vary widely, provided that they are able to perform the above-mentioned operation.

On the other hand, in the present embodiment, since the lower surfaces of the guide inclined surfaces 113*a* are formed inclined, when the flexible arm 121 is pulled out, the rear end of the flexible arm 121 is pressed against the bottom surface of the recessed portion 122 to thereby flex the flexible arm 121 in a bow shape and the flexed state of the flexible arm 121 cannot be recovered only by pressing down the rear end of the flexible arm. Due to this, on the contrary, even if an operator tries to start the connector fitting operation, the guide projections 121*b*, 121*b* are sure to go up onto the guide inclined surfaces 113*a*, 113*a*, respectively. However, this is not always limitative but, for example, even when the whole of the lower surfaces of the guide inclined surfaces 113*a* are not always be inclined but at least only the front end lower surfaces of the guide inclined surfaces 113*a* are inclined slightly downwardly, similarly, the guide projections 121*b*, 121*b* can be surely made to go up onto the guide inclined surfaces 113*a*, 113*a* with the inclined surfaces thereof in contact with each other.

Next, description will be given below of the operation of the present embodiment structured in the above-mentioned manner.

Figure 20:
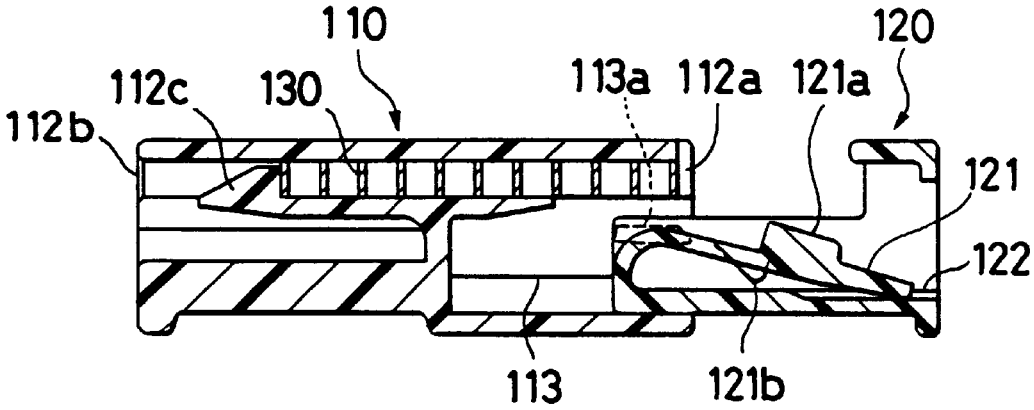
FIG. 20 is a section view of the connector when the connector fitting operation thereof is started.

That is, if the female side connector housing 120 is inserted from the state thereof shown in FIG. 19 into the hood portion 111 of the male side connector housing 110, then the two guide projections 121*b*, 121*b* provided on the two side surfaces of the flexible arm 121 are respectively allowed to go up onto the upper surfaces of the guide inclined surfaces 113*a*, 113*a*. In this operation, as shown in FIG. 20, even if the rear end of the flexible arm 121 is pressed down, the guide projections 121*b*, 121*b* of the flexible arm 121 are sure to go up onto the upper surfaces of the guide inclined surfaces 113*a*, 113*a*, that is, there is no possibility that they can go under the guide inclined surfaces 113*a*, 113*a*.

As shown in FIG. 21, since the rear end of the flexible arm 121 is raised, the securing projection 121*a* provided on the upper surface of the rear end of the flexible arm 121 is allowed to advance into the spring storage chamber 112 through the communication window 112*a* formed in the ceiling surface of the hood portion 111 and, if the female side connector housing 120 is pushed further into the male side connector housing 110, then the securing projection 121*a* is contacted with the front end of the push-back spring 30 to compress the push-back spring 130. Therefore, due to the reaction of the push-back spring 130, the female side connector housing 120 receives a force to push it back and thus, if the operation to push the female side connector housing 120 is stopped in the half inserted or fitted state, then the female side connector housing 120 is pushed out from the male side connector housing 110 due to the reaction of the push-back spring 130.

As shown in FIG. 23, at the same time when the connector reaches a normal fitted state, the guide projections 121*b*, 121*b* are allowed to go beyond the guide inclined surfaces 113*a*, 113*a* respectively. As a result of this, the flexible arm 121 is returned to its original horizontal state and thus the secured condition between the securing projection 121*a* and push-back spring 130 is removed to thereby remove the reaction of the push-back spring 130, so that the guide projections 121*b*, 121*b* are respectively engaged with the guide inclined surfaces 113*a*, 113*a* and the female and male side connector housings 120 and 110 are thereby fitted with and locked to each other.

To remove the fitted condition between the male and female side connector housings 110 and 120, the rear end of the flexible arm 121 may be pressed down and then the female side connector housing 120 may be pulled out from the male side connector housing 110. That is, if the rear end of the flexible arm 121 is pressed down, then the engagement between the guide projections 121*b*, 121*b* and guide inclined surfaces 113*a*, 113*a* can be removed and thus, as shown in FIG. 24, the guide projections 121*b*, 121*b* are then allowed to go under the lower surfaces of the guide inclined surfaces 113*a*, 113*a*, respectively. And, if the female side connector housing 120 is pulled out on, then the guide projections 121*b*, 121*b* are pressed further downwardly by the lower surfaces of the guide inclined surfaces 113*a*, 113*a*, which in turn presses the rear end of the flexible arm 121 against the bottom surface of the recessed portion 122 to thereby flex the flexible arm 121 in a bow shape. If the female side connector housing 120 is pulled out further, then the guide projections 121*b*, 121*b* are respectively allowed to pass under the lower surfaces of the guide inclined surfaces 113*a*, 113*a* so that the flexible arm 121 can be returned to its original state.

In this manner, to push back a pair of half fitted connector housings apart from each other, the guide inclined surfaces 113*a* and guide projections 121*b* respectively forming the engaging mechanism incline the flexible arm 121 which includes the securing projection 121*a* and is advanceable to and retreatable from the push-back spring 130. In particular, during the connector fitting operation, the securing projection 121*a* is secured to the push-back spring 130 to thereby allow the female side connector housing to receive the reaction of the push-back spring 130 and, on completion of the fitting operation, the securing projection 121*a* is removed from the engagement with the push-back spring 130 to thereby release the reaction of the push-back spring 130; and, during the connector pull-out operation, the guide projections 121*b* are respectively allowed to pass under the guide inclined surfaces 113*a* so that the female side connector housing can be pulled out from the male side connector housing. Also, in the initial stage of the connector fitting operation, regardless of the inclined state of the flexible arm 121, the guide projections 121*b* are sure to go up onto the guide inclined surfaces 113*a* and are thereby prevented from going under the guide inclined surfaces 113*a* as in the connector pull-out operation, which in turn eliminates the possibility that the connector can be left alone in a half fitted condition.

As has been described heretofore according to the invention, since no other separate movable member than the connector housings and push-back spring is required, it is possible to provide a connector which can remove the reaction of the push-back spring on completion of the connector fitting operation and can be simplified in structure. Also, because, in the initial stage of the connector fitting operation, the guide projections are respectively sure to go up onto their corresponding guide inclined surfaces, the guide projections are respectively prevented from going under the guide inclined surfaces, which in turn makes it sure to prevent the two connector housings from being left half fitted with each other while they are not given any reaction of the push-back spring.

Also, since the guide projections of the engaging mechanism are provided on the flexible arm, the flexible arm can be made not bulky but can be disposed easily.

Further, due to the fact that the push-back spring is supported in the peripheral wall of the hood portion while a space is formed in the portion facing the push-back spring and the flexible arm is stored in this space, the connector can be structured in such a manner that the size thereof is not bulky in the deep direction thereof.

Still further, in the connector pull-out operation, since the flexible arm is forced to flex, the connector housings can be pulled out while the flexible arm is flexed more greatly than it can be flexed in the initial stage of the connector fitting operation. On the other hand, in the initial stage of the connector fitting operation, the guide projections are surely able to go up onto their respective guide inclined surfaces.

Fourth Embodiment

Now, description will be given below of a preferred embodiment of a spring storage mechanism according to the invention with reference to the accompanying drawings.

Figure 25:
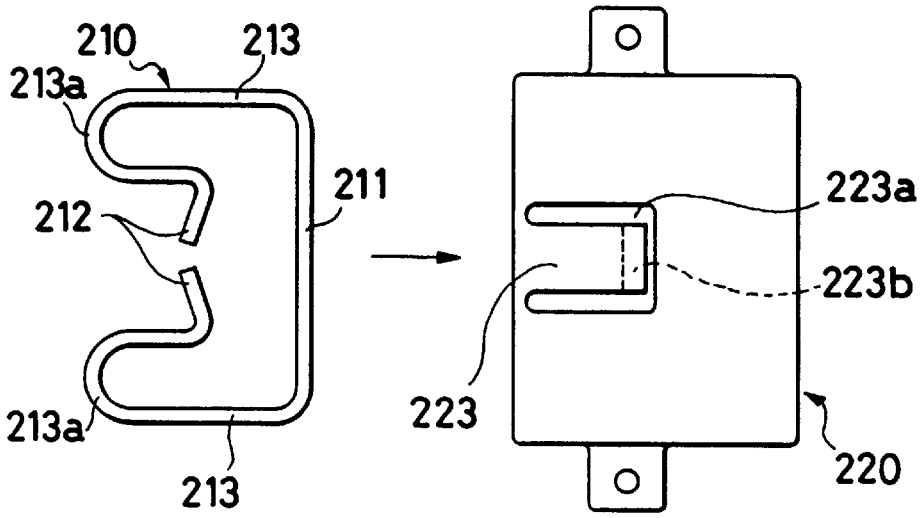
FIG. 25 is a plan view of a spring and a male side connector to which is applied an embodiment of a spring storage mechanism according to the invention.
Figure 26:
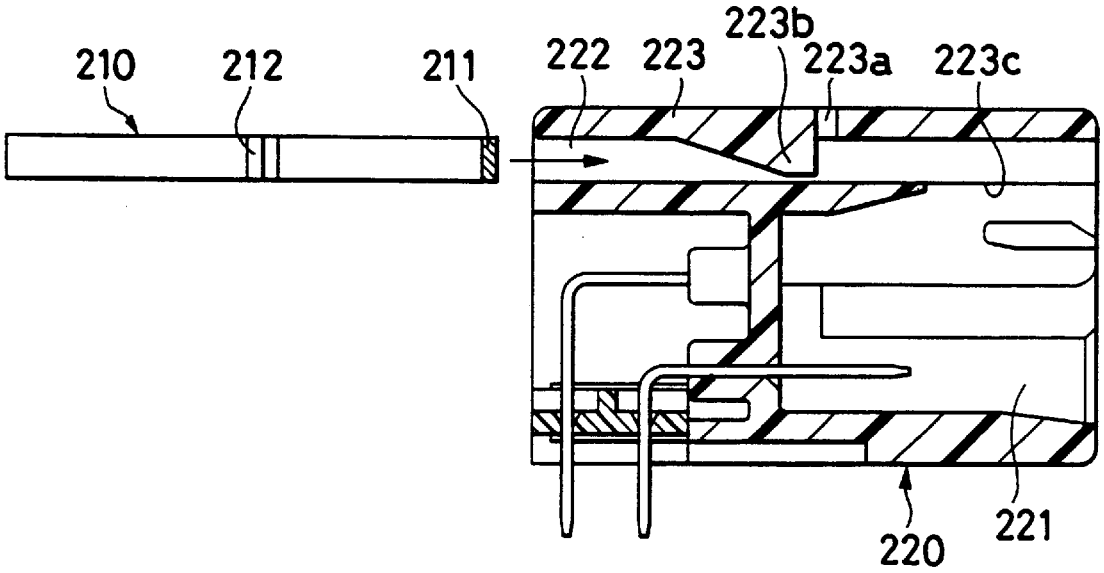
FIG. 26 is a section view of the spring and male side connector.

FIG. 25 is a plan view of an embodiment of a spring storage mechanism according to the invention, while FIG. 26 is a section of the present spring storage mechanism. In the present embodiment, a spring means 210 is to be stored in a storage chamber 222 which is formed in the ceiling surface of a male side connector 220 including a hood portion 221.

In FIG. 25, the spring means 210 is formed of spring steel by bending it into a frame shape. The spring means 210, basically, comprises a pair of front and rear side lateral parts 211 and 212 disposed substantially parallel to each other in the longitudinal direction of the spring means 210, and a pair of longitudinal parts 213 and 213 which respectively connect the outer end portions of the lateral parts 211 and 212 with each other and also which respectively include U-shaped curved portions 213*a* and 213*a* projecting out backwardly beyond the rear side lateral part 212. In the present embodiment, the central portion of the rear side lateral part 212 is arranged to provide the start and terminal points of the spring means formed of a steel spring strip member, that is, the rear side part 212 is divided here into two sections.

In the present embodiment, the spring means is formed in a frame shape. However, this is not limitative, that is, it is not always necessary to form the spring means in such a frame shape. For example, only one of the right and left sections of the frame shape may also be employed. Also, the front and rear side lateral parts 211 and 212 disposed respectively in the front and rear direction of the spring means need not always be parallel to each other, but they may be inclined at a proper angle with respect to each other according to places where the spring means is stored, the shapes of partner members to which the spring means is to be contacted or the like, or the shapes of the lateral parts 211 and 212 may be changed properly. Further, the spring means need not always be formed of spring steel but, for example, it may also be formed of other metal, resin or the like, provided that it can be used as a spring means.

The storage chamber 222 of the male side connector 220 serving as a spring storage case is formed in a flat and rectangular box shape and is opened on the rear side thereof which is located opposite to the hood portion 221 of the male side connector 220. Also, on the ceiling surface of the spring storage chamber 222, there is provided a lance 223 which is formed as an arm projecting from the rear side of the storage chamber 222 toward the front side thereof, in particular, this arm is formed of a U-shaped cut-away portion 223*a* having an opening on the back side thereof. This lance 223 further includes a wedge-shaped projection 223*b* on the inner surface of the leading end portion thereof. The wedge-shaped projection 223*b* projects more deeply into the storage chamber 222 as it approaches the leading end side of the lance 223. The wedge-shaped projection 223*b* is structured such that, when the spring means 210 is pushed into the storage chamber 222 from the back opening side of the storage chamber 222, it allows the spring means 210 to be inserted but, when the spring means 210 is pulled out of the storage chamber 222, it secures the spring means 210 there, that is, it prevents the spring means 210 from being pulled out therefrom. And, the spring storage chamber 222 forms the ceiling surface of the hood portion 221 and also includes a communication window 223*c* in communication with the interior of the hood portion 221. That is, when a mating connector or a female side connector is inserted, a projection provided in the female side connector is allowed to advance into the spring storage chamber 222 through the communication window 223*c*, where the projection can be moved back and forth.

In the present embodiment, the spring storage chamber 222 serving as a spring storage case is formed in a portion of the male side connector 220. However, this is not limitative but it may be structured as an individual body or may be formed in a portion of some member as in the present embodiment, provided that it is formed in a shape which allows at least the spring means 210 to be inserted thereinto. Similarly, this can apply to the lance 223 as well. That is, the lance 223 may also be replaced by any other means, provided that it projects into the storage chamber 222 and allows the spring means 210 to pass therethrough in the insertion direction thereof but prevents it to pass therethrough in the opposite direction. And, it is also possible to change the extending direction and shape of the arm of the lance properly according to cases. Further, the wedge-shaped projection 223*b* may also be changed to another shape difficult to slip out of position according to the shape of the lateral part 212 of the spring means 210 to be secured thereto. In the present embodiment, the spring means 210 is structured in a bilaterally symmetrical frame shape and the rear side lateral part 212 is divided at the center thereof into two sections, so that the two sections can be respectively secured to the wedge-shaped projection 223*b*.

Next, description will be given below of the operation of the present embodiment structured in the above-mentioned manner.

Figure 27:
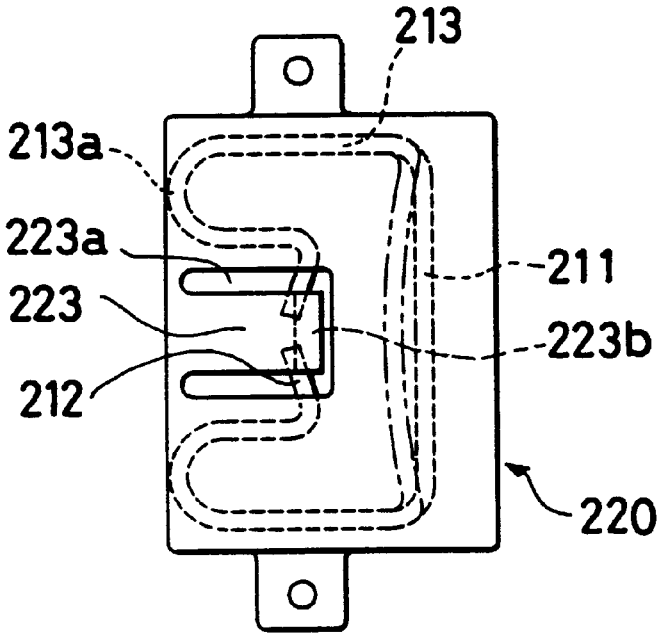
FIG. 27 is a plan view of the spring and male side connector, showing a process for storing the spring.
Figure 28:
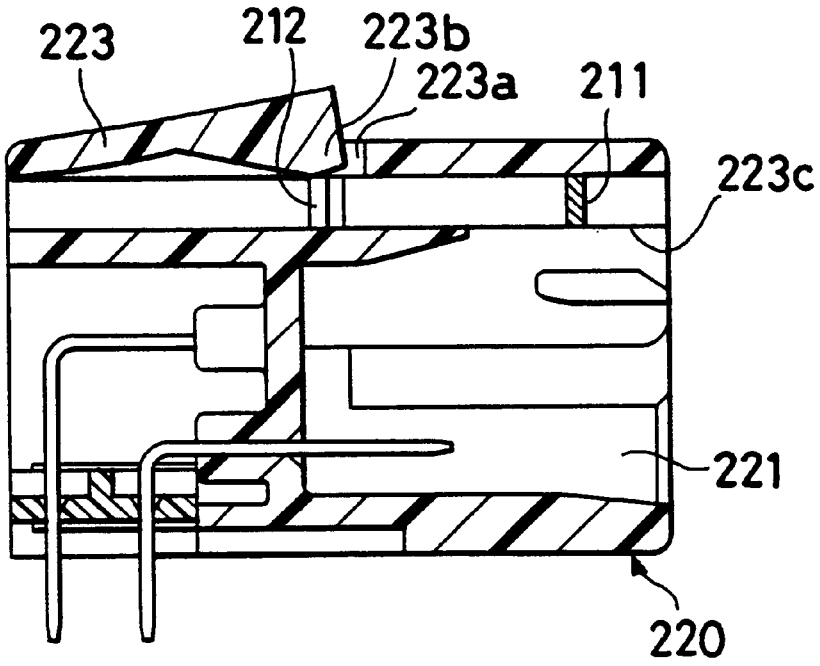
FIG. 28 is a section view of the spring means and male side connector.
Figure 29:
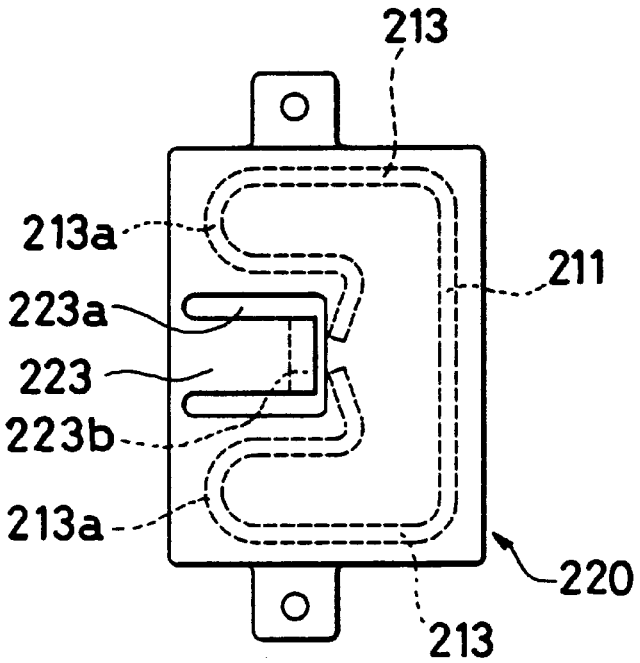
FIG. 29 is a plan view of the spring and male connector after the spring is stored.
Figure 30:
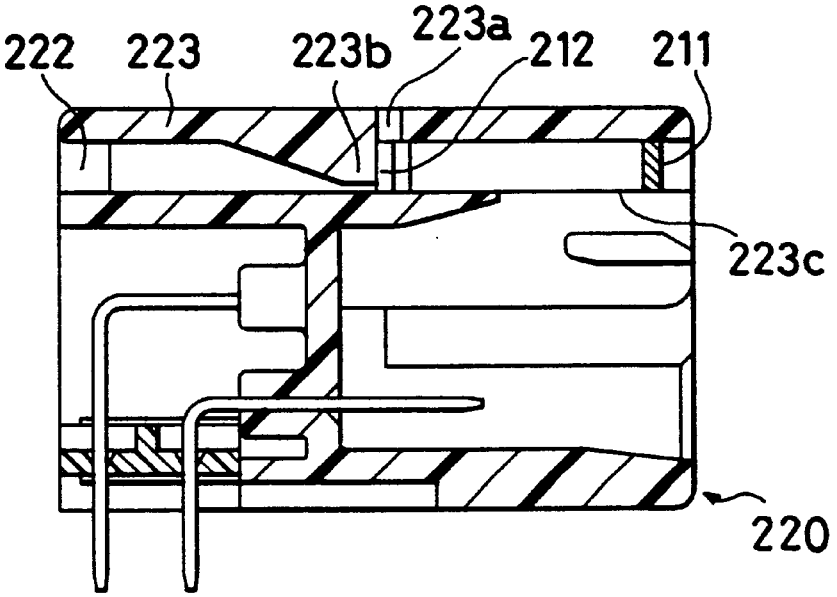
FIG. 30 is a section view of the spring means and male side connector.

As shown in FIGS. 25 and 26, the front side lateral part 211 of the spring means 210 is made to face the rear end opening of the spring storage chamber 222 of the male side connector 220 and is then inserted through the rear end opening into the spring storage chamber 222. If the spring means 210 is pushed into the spring storage chamber 222 while supporting the curved portions 213*a* and 213 of the spring means 210, as shown in FIG. 27, the front side lateral part 211 passes through the lance 223 ahead and, after then, the rear side lateral part 212 comes to face the lower surface of the lance 223. During this operation, as shown in FIG. 28, the rear side lateral part 212 pushes up the wedge-shaped projection 223*b* while passing through the lance 223. After then, if the spring means 210 is further pushed into the spring storage chamber 222, then the rear side lateral part 212 is allowed pass through the lance 223, as shown in FIGS. 29 and 30. After the rear side lateral part 212 has passed through the lance 223, the lateral part 212 is secured to the lance 223 and is thereby prevented against removal. During this operation, an operator has only to push the rear portions of the curved portions 213*a* and 213*a* of the spring means 210, that is, it is not necessary for the operator to use any tool such as a jig so that the rear end portions of the spring means 210 can be pushed in beyond the lance 223.

On the other hand, when the spring means 210 is not pushed in completely, as shown in FIG. 28, the wedge-shaped projection 223*b* of the lance 223 is left pushed up by the rear side lateral part 212 and, therefore, when the male side connector 220 is viewed visually from outside, it can be found that the portion of the ceiling surface of the connector 220 corresponding to the lance 223 is left projected out. Due to this, the half insertion condition of the spring means 210 can be detected easily. In this manner, in the present embodiment, the visual detection is employed to detect the half insertion condition of the spring means 210. However, this is not limitative. For example, the projecting condition of the spring means 210 can also be detected by use of a sensor, that is, the projecting condition can be detected by a sensor automatically.

Now, when a female side connector is inserted into the hood portion 221 of the male side connector 220, then a projection provided in the female side connector advances through the communication window 223*c* into the storage chamber 222 and, as shown by a two-dot chained line in FIG. 29, the projection runs up against the front side lateral part 211 to compress the spring means 210, so that the projection receives a reaction to this.

As has been described heretofore, the present spring means 210 comprises a pair of front and rear side lateral parts 211 and 212 respectively serving as a fulcrum and a point of action, and a pair of longitudinal parts 213 respectively connecting the two lateral parts 211 and 212 with each other, while each of the longitudinal parts 213 include the curved portion 213*a* projecting out backwardly of the rear side lateral part 212. In operation, if the spring means 210 is pushed into the spring storage chamber 222 of the male side connector 220 serving as a spring storage case while supporting the curved portions 213*a* thereof without using any jig, then not only the front side lateral part 211 but also the rear side lateral part 212 are pushed into the spring storage chamber 222 ahead of the curved portions 213*a*, and the rear side lateral part 212 is secured to the lance 223 formed in the ceiling wall of the storage chamber 222.

As has been described above, according to the invention, there can be provided a spring storage mechanism which not only is able to push the spring means into the spring storage case until it is secured to the lance without using a jig by storing the spring means while the curved portions of the spring means projected backwardly are being supported, but also can reduce the number of the components of the spring storage mechanism.

Also, since the spring means is inserted into the spring storage case while the right and left end portions thereof are being supported, the spring means can be inserted stably and smoothly.

Further, because the lance is left projected out externally when the spring means is half inserted, the half inserted condition of the spring means can be visually detected from outside.

What is claimed is:

1. A spring storage mechanism in an electrical connector, the spring storage mechanism comprising:

a spring including a front lateral part and a rear lateral part, and at least one longitudinal part connecting said front and rear lateral parts of said spring with each other, the at least one longitudinal part including a substantially U-shaped curved portion projecting backwardly beyond said rear lateral part of said spring; and a storage case having an open rear end and capable of storing said spring therein, said storage case including on a peripheral wall thereof a lance formed in an arm shape, said lance including a wedge-shaped projection provided on and projecting from an inner surface of said lance so as to be securable to said rear lateral part of said spring.

2. A spring storage mechanism as claimed in claim 1, wherein said spring is formed in a bilaterally symmetrical shape.

3. A spring storage mechanism as claimed in claim 1, wherein said lance is exposed to an outer peripheral surface of said storage case.

* * * * *